US005244762A

United States Patent [19]

Spiewak et al.

[11] Patent Number: 5,244,762

[45] Date of Patent: Sep. 14, 1993

[54] ELECTROPHOTOGRAPHIC IMAGING MEMBER WITH BLOCKING LAYER CONTAINING UNCROSSLINKED CHEMICALLY MODIFIED COPOLYMER

[75] Inventors: John W. Spiewak, Webster; Huoy-Jen Yuh, Pittsford; Joseph Mammino, Penfield; Robert C. U. Yu, Webster; Cindy Chen, Rochester; Raymond K. Crandall, Pittsford; Steven J. Grammatica, Penfield, all of N.Y.

[73] Assignee: Xerox Corporation, Stamford, Conn.

[21] Appl. No.: 816,994

[22] Filed: Jan. 3, 1992

[51] Int. Cl.[5] ..... G03G 5/14

[52] U.S. Cl. ..... 430/64; 430/58

[58] Field of Search ..... 430/64, 62, 63, 58

[56] References Cited

U.S. PATENT DOCUMENTS

| | | | |
|---|---|---|---|
| 3,554,747 | 1/1971 | Dastoor | 96/1.8 |
| 3,595,647 | 7/1971 | Yasumor et al. | 96/1.5 |
| 3,672,889 | 6/1972 | Baltazzi et al. | 96/1.8 |
| 4,535,045 | 8/1985 | Kawamura et al. | 430/69 |
| 4,822,705 | 4/1989 | Fukagai et al. | 430/60 |
| 4,988,597 | 1/1991 | Spiewak et al. | 430/64 |
| 5,063,128 | 11/1991 | Yuh et al. | 430/64 |

FOREIGN PATENT DOCUMENTS 0448780 10/1991 European Pat. Off. .

*Primary Examiner*—John Goodrow

[57] ABSTRACT

An electrophotographic imaging member including a supporting substrate, a charge blocking layer, an imaging layer including at least one photoconductive layer, the blocking layer including an uncrosslinked copolymer derived from vinyl hydroxy ester or vinyl hydroxy amide repeat units chemically modified at a nucleophilic hydroxyl group by a monofunctional electrophile, the copolymer having a number average molecular weight of at least about 10,000.

20 Claims, No Drawings

ELECTROPHOTOGRAPHIC IMAGING MEMBER WITH BLOCKING LAYER CONTAINING UNCROSSLINKED CHEMICALLY MODIFIED COPOLYMER

BACKGROUND OF THE INVENTION

This invention relates in general to electrophotography and, more specifically, to a novel photoconductive device and process for using the device.

A photoconductive layer for use in electrophotography may be a homogeneous layer of a single material such as vitreous selenium or it may be a composite layer containing a photoconductor and another material. One type of composite photoconductive layer used in electrophotography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer.

Various combinations of materials for charge generating layers (CGL) and charge transport layers (CTL) have been investigated. For example, the photosensitive member described in U.S. Pat. No. 4,265,990 utilizes a charge generating layer in contiguous contact with a charge transport layer comprising a polycarbonate resin and one or more of certain diamine compounds. Various generating layers comprising photoconductive layers exhibiting the capability of photogeneration of holes and injection of the holes into a charge transport layer have also been investigated. The charge generation layer may comprise a homogeneous photoconductive material or particulate photoconductive material dispersed in a binder. Other examples of homogeneous and binder charge generation layer are disclosed, for example, in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirety. Photosensitive members having at least two electrically operative layers as disclosed above provide excellent images when charged with a uniform negative electrostatic charge, exposed to a light image and thereafter developed with finely divided electroscopic marking particles. Where polymers such as vinyl hydroxy ester or vinyl hydroxy amide polymers are utilized in adjacent charge blocking layers, poor adhesion is encountered and an additional intervening adhesive is often desirable. Also, when some binder materials are employed in a blocking layer or charge generating layer, the binder can be attacked by some of the solvents employed to apply subsequent layers. Solvent attack of an underlying layer such as the blocking layer cannot normally be tolerated in precision copiers, duplicators, and printers.

INFORMATION DISCLOSURE STATEMENT

EP 0 448 780 A1 to Spiewak et al, published Oct. 10, 1991—An electrophotographic imaging member is disclosed containing a substrate having an electrically conductive surface, a charge blocking layer including a vinyl hydroxy ester or vinyl hydroxy amide polymer and at least one photoconductive layer. The vinyl hydroxy ester or vinyl hydroxy amide polymer may be reacted with polyfunctional compounds to crosslink the polymer.

U.S. Pat. No. 4,535,045 issued to Kawamura et al on Aug. 13, 1985—appears to disclose a light-sensitive layer comprising a vinylidene chloride or vinyl chloride, a vinyl based unsaturated monomer, and a vinyl monomer comprising a hydroxyl group. The vinyl monomer may comprise hydroxyethyl acrylate, hydroxyethyl methacrylate, and 2-hydroxypropyl methacrylate (e.g. see column 4, line 60–column 5, line 15).

U.S. Pat. No. 3,595,647 issued to Yasumori et al on Jul. 27, 1971—A photoconductive layer is disclosed comprising a binder comprising a mixture composed of (1) a copolymer of hydroxyethyl- (or meth-) acrylate and vinyl monomer having carboxylic acid radicals; (2) a mixture of a copolymer formed from carboxylic acid monomer, vinyl monomer, and an organic acid anhydride; and (3) a mixture comprising the copolymer in (1) and the organic acid anhydride of (2).

U.S. Pat. No. 3,554,747 issued to Dastoor on Jan. 12, 1971—An electrostatic printing material is disclosed comprising a conductive support layer and a second layer wherein the second layer comprises a polymeric binder. The polymeric binder comprises ethyl acrylate selected from the group comprising hydroxyethyl methacrylate and hydroxypropyl methacrylate (e.g. see column 2, lines 27–52).

U.S. Pat. No. 3,672,889 issued to Baltazzi et al on Jun. 27, 1972—A polymeric resin binder is disclosed comprising a terpolymer comprising ethyl acrylate or ethyl methacrylate, a vinyl-aryl compound such as styrene, and an acrylate composed of amino, hydroxy, or acid functional groups (e.g. see column 2, lines 38–72).

Thus, the characteristics of photosensitive members comprising a support having a conductive layer, a charge blocking layer and at least one photoconductive layer, exhibit deficiencies as electrophotographic imaging members.

SUMMARY OF THE INVENTION

It is an object of the invention to provide an electrophotographic imaging member which overcomes the above-noted disadvantages.

It is another object of this invention to provide an electrostatographic imaging member having extended life.

It is another object of this invention to provide an electrostatographic imaging member exhibiting improved adhesion between layers, particularly between a charge blocking layer and a charge generating layer.

It is another object of this invention to provide an electrostatographic imaging member that charges to high voltages useful in xerography.

It is another object of this invention to provide an electrostatographic imaging member which allows photodischarge with low dark decay and low residual voltage during extended cycling.

It is another object of the invention to provide an electrostatographic imaging member that is simpler to fabricate.

It is another object of the invention to provide an electrostatographic imaging member having a blocking layer that is resistant to disturbance or dissolving by components of subsequently applied layers.

These and other objects of the present invention are accomplished by providing an electrophotographic imaging member comprising a supporting substrate, an imaging layer comprising at least one photoconductive layer, the blocking layer comprising an uncrosslinked copolymer derived from vinyl hydroxy ester or vinyl hydroxy amide repeat units some of which have been chemically modified at the nucleophilic hydroxyl group by a monofunctional electrophile, the copolymer having a number average molecular weight of at least about 10,000. This imaging member may be employed in an electrostatographic imaging process.

The supporting substrate layer having an electrically conductive surface may comprise any suitable rigid or flexible member such as a flexible web or sheet. The supporting substrate layer having an electrically conductive surface, may be opaque or substantially transparent, and may comprise numerous suitable materials having the required mechanical properties. For example, it may comprise an underlying insulating support layer coated with a thin flexible electrically conductive layer, or merely a conductive layer having sufficient internal strength to support the electrophotoconductive layer. Thus, the electrically conductive layer may comprise the entire supporting substrate layer or merely be present as a component of the supporting substrate layer, for example, as a thin flexible coating on an underlying flexible support member.

The electrically conductive layer may comprise any suitable electrically conductive organic or inorganic material. Typical electrically conductive layers including, for example, aluminum, titanium, nickel, chromium, brass, gold, stainless steel, carbon black, graphite, metalloids, cuprous iodide, indium tin oxide alloys, Lewis acid doped polypyrrole and the like. The electrically conductive layer may be homogeneous or heterogeneous, e.g. conductive particles dispersed in a film forming binder. When hole injecting materials such as carbon black, copper iodide, gold and other noble metals, platinum, polypyrrole, polyaromatic conducting polymers, polythiophenes, conducting metallic oxide such as antimony tin oxide, indium tin oxide, and the like are utilized in a conductive layer, photoreceptors that do not contain a suitable blocking layer can often discharge in the dark thereby rendering the photoreceptor unsuitable for electrophotographic imaging. The ground plane should be continuous and at least monomolecular in thickness. The continuous conductive layer may vary in thickness over substantially wide ranges depending on the desired use of the electrophotoconductive member. Accordingly, the conductive layer can generally range, for example, in thicknesses of from about 50 Angstrom units for some materials to many centimeters. For some ground planes, such as those containing carbon black, a minimum thickness of about 0.5 micrometer is preferred. When a highly flexible photoresponsive imaging device is desired, the thickness of conductive layers may be between about 100 Angstroms to about 2,000 Angstroms. The resistivity of the ground plane should be less than about $10^8$ and more preferably $10^6$ ohms/square for efficient photoreceptor discharge during repeated cycling. If an underlying flexible support layer is employed, it may be of any conventional material including metal, plastics and the like. Typical underlying flexible support layers include insulating or non-conducting materials comprising various resins or mixtures thereof with conductive particles, such as metals, carbon black and the like, known for this purpose including, for example, polyesters, polycarbonates, polyamides, polyurethanes, and the like. The coated or uncoated supporting substrate layer having an electrically conductive surface may be rigid or flexible and may have any number of different configurations such as, for example, a sheet, a cylinder, a scroll, an endless flexible belt, and the like. Preferably, the flexible supporting substrate layer having an electrically conductive surface comprises an endless flexible belt of commercially available polyethylene terephthalate polyester coated with a thin flexible metal coating. Generally, the material selected for the ground plane should not be attacked by solvents ultimately selected for use with the subsequently applied blocking layer. If the blocking layer solvent attacks the ground plane, it may leach out and/or physically dislodge hole injecting components from the ground plane into the blocking layer. In subsequent coating operations, these already migrated hole injection components in the blocking layer may further migrate into the charge generating layer or charge transporting layer from which dark discharge and low charge acceptance can occur. Since hole injection in the charge generating layer or charge transporting layer is cumulative with xerographic cycling, $V_0$ also decreases with cycling ($V_0$ cycle-down).

A charge blocking layer is interposed between the conductive surface and the imaging layer. The imaging layer comprises at least one photoconductive layer. This blocking layer material traps positive charges. The charge blocking layer of this invention comprises a uniform, continuous, coherent blocking layer comprising an uncrosslinked polymer derived from vinyl hydroxy ester or vinyl hydroxy amide repeat units chemically modified at least in part at the nucleophilic hydroxyl group by a monofunctional electrophile. The improved adhesion achieved by the use of the blocking layer of this invention eliminates the need for an adhesive layer between the blocking layer and the adjacent photoconductive layer while simultaneously maintaining acceptable, stable cyclic electrical properties. Depending upon the specific composition of the photoconductive layer utilized, improvements in adhesion using only the blocking layer of this invention instead of the combination of a siloxane blocking layer and a polyester adhesive layer ranged from a 100 percent improvement to an improvement of over 3,900 percent. This improvement in adhesion is especially desirable for preventing delamination of flexible, welded or seamless photoreceptor belts.

The chemically modified copolymer of the blocking layer of this invention is preferably derived from vinyl hydroxy ester or vinyl hydroxy amide repeat units some of which have been chemically modified at the nucleophilic hydroxyl group by a monofunctional electrophile. Chemical modification of the vinyl hydroxy ester or vinyl hydroxy amide repeat units at the nucleophilic hydroxyl group by a monofunctional electrophile may be effected on these polymeric repeat units after polymerization or the same chemical modification may be effected on the vinyl hydroxy ester or vinyl hydroxy amide monomers prior to polymerization. Preferably, the vinyl hydroxy ester or vinyl hydroxy amide repeat units make up between about 50 mole percent and about 100 mole percent of the copolymer prior to chemical modification.

A chemically modified polymer may be a homopolymer if 100 percent modified by the same modifier or may be a copolymer if not completely modified or if the unmodified polymer was modified by more than one modifier, but the partially modified copolymer will always be a component of the blocking layer composition of this invention whereas the 100 percent chemically modified homopolymer or 100 percent unmodified homopolymer may not always be a blocking layer component of this invention. However in some preferred adhesive blocking layer embodiments of this invention, the unmodified vinyl hydroxy ester or vinyl hydroxy amide homopolymer having the same unmodified repeat unit that resides in the modified copolymer to be mixed with the homopolymer (every vinyl hydroxy ester or vinyl hydroxy amide modified copolymer must have some unmodified repeat units) produces blocking layer blends with excellent interfacial adhesion between the charge generating layer and the blocking layer. The modified vinyl hydroxy ester or vinyl hydroxy amide copolymer may be a random copolymer of 2 or more different monomers or a block or segmented (segmented means a short block that occurs more frequently than the longer block) copolymer of 2 or more different monomers. The random copolymers are preferred because of their relative ease of synthesis or availability. Moreover, the modified vinyl hydroxy ester or vinyl hydroxy amide copolymers in this invention can contain a random or non-blocky or non-segmented repeat unit sequence in which are contained atactic, syndiotactic and/or isotactic triad sequences. Optionally the copolymers can contain a blocked or segmented repeat unit sequence in which are contained atactic, syndiotactic, and/or isotactic triad sequences. All possible copolymer repeat unit sequences and tacticity sequences may co-exist in the modified and unmodified copolymers of this invention. If desired, the blocking layer may comprise a blend of one or more chemically modified copolymers, or may comprise a blend of one or more chemically modified copolymers blended with either or both—one or more chemically unmodified homopolymers or—one or more 100 percent chemically modified homopolymers.

The uncrosslinked vinyl hydroxy ester or vinyl hydroxy amide polymer, prior to chemical modification of vinyl hydroxy ester or vinyl hydroxy amide repeat units at the nucleophilic hydroxyl group by a monofunctional electrophile, may be a homopolymer or a copolymer. Preferred vinyl hydroxy ester or vinyl hydroxy amide repeat units prior to chemical modification are represented by the following formula:

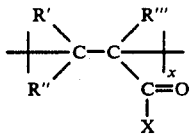

wherein:

x represents sufficient repeat units for a total polymer molecular weight of at least about 10,000, X is selected from the group consisting of groups represented by the following groups:

R is selected from the group consisting of aliphatic, aromatic, heteroaliphatic, heteroaromatic, fused aromatic ring and heteroaromatic ring groups containing up to 10 carbon atoms;

z contains from 1 to 10 hydroxyl groups; and $-O-R-(OH)_z$, $-NH-R-(OH)_z$, $-NR-R-(OH)_z$ and -continued

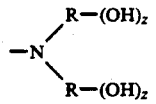

R', R'' and R''' are independently selected from the group consisting of hydrogen, aliphatic, aromatic, heteroaliphatic, heteroaromatic, fused aromatic ring and heteroaromatic ring groups containing up to 10 carbon atoms.

Typical divalent R aliphatic groups include methylene, ethylene, propylene, ethylidene, propylidene, isopropylidene, butylene, isobutylene, decamethylene, phenylene, biphenylene, piperadinylene, tetrahydrofuranylene, pyranylene, piperazinylene, pyridylene, bipyridylene, pyridazinylene, pyrimidinylene, naphthylidene, quinolinyldene, cyclohexylene, cyclopentylene, cyclobutylene, cycloheptylene, and the like.

Typical monovalent R', R'' and R''' groups include hydrogen, methyl, ethyl, propyl, isopropyl, butyl, isobutyl, decyl, phenyl, biphenyl, piperadinyl, tetrahydrofuranyl, pyranyl, piperazinyl, pyridyl, bipyridyl, pyridazinyl, naphthyl, quinolinyl, cyclohexyl, cyclopentyl, cyclobutyl, cycloheptyl, and the like. Preferably, R' and R'' are hydrogen.

Typical aliphatic, aromatic, heteroaliphatic, heteroaromatic, fused aromatic ring and heteroaromatic ring groups containing up to 10 carbon atoms include linear, single ring and multiple ring, fused and unfused groups such as naphthalene, thiophene, quinoline, pyridine, furan, pyrrole, isoquinoline, benzene, pyrazine, pyrimidine, bipyridine, pyridazine, and the like.

The uncrosslinked polymers described above involving at least a vinyl hydroxy ester or vinyl hydroxy amide monomer that contain vinyl hydroxy ester or vinyl hydroxy amide repeat units that have not been chemically modified through a nucleophilic hydroxyl group by a monofunctional electrophile are described in copending U.S. patent application Ser. No. 07/691,180 filed on Apr. 25, 1991 to Spiewak et al, which is a continuation application of U.S. patent application Ser. No. 07/459,916 filed on Dec. 29, 1989. The European patent application corresponding to U.S. patent application Ser. No. 07/459,916 is EP 0 448 780 A1 published Oct. 10, 1991. The entire disclosures of U.S. patent application Ser. No. 07/691,180 filed on Apr. 25, 1991 and EP 0 448 780 A1 published Oct. 10, 1991 are incorporated herein by reference.

Typical chemically unmodified vinyl hydroxy ester polymers and vinyl hydroxy amide polymers include the following unmodified homopolymers and any copolymer combinations thereof: poly(2-hydroxyethyl)methacrylate, poly(2-hydroxyethyl)acrylate, poly(2-hydroxypropyl)methacrylate, poly(2-hydroxypropyl)acrylate, poly(4-hydroxybutyl)methacrylate, poly(4-hydroxybutyl)acrylate, poly(3-hydroxypropyl)methacrylate, poly(3-hydroxypropyl)acrylate, poly(2,3-dihydroxypropyl)methacrylate, poly(2,3-dihydroxypropyl)acrylate, poly(2,3,4-trihydroxybutyl)methacrylate, poly(2,3,4-trihydroxybutyl)acrylate, poly(N-2,3 dihydroxypropyl)methacrylamide, poly(N-2,3 dihydroxypropyl)acrylamide, poly(N-hydroxymethyl)methacrylamide, poly(N-hydroxymethyl)acrylamide, poly(N-2-hydroxyethyl)methacrylamide, poly(N-2-hydroxyethyl)acrylamide, poly(4-hydroxyphenyl)methacrylate, poly(4-hydroxyphenyl)acrylate, poly(3-hydroxyphenyl)- methacrylate, poly(3-hydroxyphenyl)acrylate, poly(N-3 or 4-hydroxyphenyl)methacrylamide, poly(N-3 or 4-hydroxyphenyl)acrylamide, poly[4(2-hydroxypyridyl]methacrylate, poly[4(2-hydroxypyridyl]acrylate, poly[4(3-hydroxypiperidinyl]methacrylate, poly[4(3-hydroxypiperidinyl]acrylate, poly[N-4(2-hydroxypyridyl]methacrylamide, poly[N-4(2-hydroxypyridyl]acrylamide, poly[N-4(3-hydroxypiperindinyl]-methacrylamide, poly[N-4(3-hydroxypiperindinyl]acrylamide, poly[1(5-hydroxynaphthyl]methacrylate, poly[1(5-hydroxynaphthyl]acrylate, poly[N-1(5-hydroxyethylnaphthyl]methacrylamide, poly[N-1(5-hydroxyethylnaphthyl]acrylamide, poly[1(4-hydroxycyclohexyl]methacrylate, poly[1(4-hydroxycyclohexyl]acrylate, poly[N-1(3-hydroxycyclohexyl]methacrylamide, poly[N-1(3-hydroxycyclohexyl]acrylamide, and the like.

Modified Copolymers and Blends of Modified Copolymers

Typical preferred uncrosslinked vinyl hydroxy ester or vinyl hydroxy amide copolymers containing both chemically modified vinyl hydroxy ester or vinyl hydroxy amide repeat units (repeat unit B) and unmodified vinyl hydroxy ester or amide repeat units (repeat unit A) wherein the chemical modification was carried out at the nucleophilic hydroxyl group by a monofunctional electrophile may be represented by the following formula:

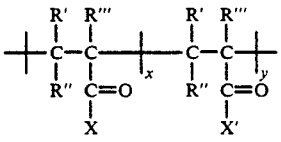

Unmodified Repeat Unit A — Modified Repeat Unit B wherein for Unmodified Repeat Unit A:

R', R'' and R''' are independently selected from the group consisting of hydrogen, aliphatic, aromatic, heteroaliphatic, heteroaromatic, fused aromatic ring and heteroaromatic ring groups containing up to 10 carbon atoms, x represents the number of repeat units of unmodified repeat unit A, X is selected from the group consisting of groups represented by the following groups:

$$-O-R-(OH)_z,\ -NH-R-(OH)_z,\ -NR-R-(OH)_z \text{ and}$$

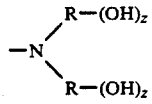

wherein

R is selected from the group consisting of aliphatic, aromatic, heteroaliphatic, heteroaromatic, fused aromatic ring and heteroaromatic ring groups containing up to 10 carbon atoms, and z is from 1 to 10 hydroxyl groups, and wherein for Modified Repeat Unit B:

R', R'' and R''' are independently selected from the group consisting of hydrogen, aliphatic, aromatic, heteroaliphatic, heteroaromatic, fused aromatic ring and heteroaromatic ring groups containing up to 10 carbon atoms, y represents the number of repeat units of modified repeat unit B in one or more modified copolymers comprising the blocking layer composition in which y can be any positive whole number, x plus y represent sufficient repeat units for a molecular weight of at least about 10,000, X' is selected from the group consisting of groups represented by the following groups:

wherein $$-O-R-(OZ)_{z'},\ -NH-R-(OZ)_{z'},\ -NR-R-(OZ)_{z'} \text{ and}$$

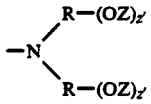

R is selected from the group consisting of aliphatic, aromatic, heteroaliphatic, heteroaromatic, fused aromatic ring and heteroaromatic ring groups containing up to 10 carbon atoms, Z represents a moiety from the monofunctional electrophile, and z and z' are whole numbers.

As indicated above, x represents the number of repeat units of unmodified repeat unit A in the one or more modified copolymer(s) comprising the blocking layer composition (no homopolymers in this blocking layer composition since x or y never equals 0; the homopolymer embodiment will be addressed hereinafter) in which x can be any positive whole number such that the resulting blocking layer produces satisfactory adhesion to the charge generating layer; wherein the unmodified repeat units A in each modified copolymer are between about 25 percent and about 79 percent of all the repeat units (x+y) in the modified copolymer or, in at least one modified copolymer in a blend of modified copolymers, comprising the blocking layer. Unmodified repeat units A in each modified copolymer between about 50 percent and about 70 percent of all the repeat units is preferred with optimum results being achieved with between about 40 percent and about 60 percent.

As specified above, y represents the number of repeat units of modified repeat unit B in one or more modified copolymers comprising the blocking layer composition (no homopolymers in this blocking layer composition since x or y never equals 0) in which y can be any positive whole number such that the resulting blocking layer produces satisfactory adhesion to the charge generating layer; wherein the modified repeat units B in each copolymer are between about 21 percent and about 75 percent of all the repeat units (x+y) in the modified copolymer or, in at least one modified copolymer of a blend of modified copolymers, comprising the blocking layer. The tabular results in the working Examples suggest that blocking layers containing modified copolymers having 20 or less mole percent modified repeat units afford unsatisfactory adhesion to the charge generating layer. The above range defines the repeat unit content of the modified copolymers (which are mandatory components of the blocking layer) for good adhesion. It is believed that blocking layers containing modified copolymers having modified repeat unit contents between about 21 mole percent and about 75 mole percent produce satisfactory adhesion to the charge generating layer. When the modified content exceeds about 75 mole percent modified repeat units, the solubility of these blocking layers in subsequently used organic coating solvents increases to such an extent that significantly poorer electrical properties due to layer mixing will be encountered.

As to z and z' denoted above, they are whole numbers for modified copolymers or blends of modified copolymers generated by modifying one or more vinyl hydroxy ester or vinyl hydroxy amide homopolymer or copolymer to give sufficient modified repeat units B to meet the between about 21 mole percent and about 75 mole percent limits and sufficient unmodified repeat units A to meet the between about 79 mole percent and about 25 mole percent range in at least one of the modified copolymers of a blend thereof; wherein z in unmodified repeat units A can be 1-10 and z' in modified repeat units B can also be 1-10; when z=z,' all the hydroxyl groups in unmodified repeat unit A have undergone modification to give modified repeat unit B; and when z' is<z, less than all the hydroxyl groups in unmodified repeat unit A have undergone modification to give modified repeat unit B. If modified repeat units are instead generated at the monomer stage by modifying different vinyl hydroxy ester or vinyl hydroxy amide monomers containing different amounts of hydroxy groups per repeat unit, followed by polymerization thereof, then z and z' become mathematically unrelated to each other.

The upper molecular weight limit of the chemically modified vinyl hydroxy ester or vinyl hydroxy amide copolymers, which must at least in part comprise the blocking layer of this invention, is determined by the increasing viscosity of the copolymer or copolymer blend coating solution used in the chosen coating process. At very high copolymer molecular weights and practically useful concentrations, the coating solution may be too viscous to form a uniform coherent blocking layer coating. The lower molecular weight limit of same is determined by the minimum copolymer molecular weight (about 10,000) at which the resulting coating will be coherent and of uniform thickness. The electrophotographic imaging device performance improves as the blocking layer copolymer molecular weight increases because high molecular weight copolymers have improved solvent barrier properties making less likely any disturbance of the blocking layer or the underlying conductive layer when solvent coating the upper device layers (e.g. the charge generating layer and the charge transport layer). Thus, layer mixing and the deleterious electrical properties resulting therefrom are less likely when high molecular weight blocking layer copolymers are used. The same molecular weight considerations apply to blocking layers of this invention comprising one or more modified or unmodified homopolymers that may be blended with one or more modified copolymers.

Polymer Blends Between One or More Modified Copolymers and One or More Modified or Unmodified Homopolymers Two types of polymer blends are plausible in formulating the miscible blocking layer compositions of this invention: (1) blends of two or more different vinyl hydroxy ester or vinyl hydroxy amide modified copolymers, already discussed above, and (2) blends of one or more different vinyl hydroxy ester or vinyl hydroxy amide modified copolymers with either the same or one or more different vinyl hydroxy ester or vinyl hydroxy amide homopolymers. The expression "same" means that the homopolymer repeat units are the same as those of one of the modified or unmodified repeat units in one of the modified copolymers used in the blocking layer composition. Blends between two homopolymers (both modified, or both unmodified, or one modified and one not modified) are not considered as blocking layer compositions of this invention because these blends will not be miscible or will not have improved adhesive properties or improved solvent resistance to subsequently used coating solvents.

The chemically modified vinyl hydroxy ester or vinyl hydroxy amide copolymers may be used alone in the blocking layer of this invention or blended with other miscible homopolymers or copolymers. Miscibility is defined as a non-hazy coating (after drying) of equal amounts of the polymers cast from a common solution of the two polymers in one solvent. When a blend of two or more chemically modified vinyl hydroxy ester or vinyl hydroxy amide copolymers are used alone as the blocking layer composition in this invention, the copolymers may contain a common unmodified repeat unit (A) or a common modified repeat unit (B) or may contain no common repeat units of any kind as long as the dried blocking layer is visually miscible. Layer clarity arising from polymer miscibility in the dried coatings allows for the use of backside light exposure, in a controllable reproduceable manner, to reach the charge generator layer through transparent conductive and blocking layers in electrophotographic devices coated upon transparent belt substrates. For non-transparent substrates such as a drum or an opaque belt, the layers beneath the charge generator layer need not be transparent because frontside exposure through the transparent charge transport layer would be routinely used. In frontside exposure devices, the adhesive-blocking layers of this invention may be used in many more combinations without regard for blocking layer clarity. In such electrically satisfactory blocking layers, it is the enhanced adhesion to the charge generator layer (attributable to at least a minimal presence of one or more modified vinyl hydroxy ester or vinyl hydroxy amide copolymers and the optional presence of one or more modified or unmodified homopolymers) that is gained by using the blocking layer polymer compositions of this invention versus similar blocking layers not containing a modified vinyl hydroxy ester or vinyl hydroxy amide component. One or more copolymers represented by the foregoing formula containing the modified repeat unit B can be blended with one or more other suitable uncrosslinked homopolymers or copolymers that contains unmodified or modified repeat units.

Typical preferred unmodified uncrosslinked vinyl hydroxy ester or vinyl hydroxy amide homopolymers or copolymers that may be blended with modified copolymers containing the above described modified Repeat Unit B may be represented by the following formula:

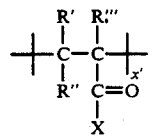

Unmodified Repeat Unit C wherein for Unmodified Repeat Unit C:

R', R'' and R''' are independently selected from the group consisting of hydrogen, aliphatic, aromatic, heteroaliphatic, heteroaromatic, fused aromatic ring and heteroaromatic ring groups containing up to 10 carbon atoms, x' represents the number of repeat units of uncrosslinked unmodified repeat unit C in the unmodified copolymer or homopolymer, X is selected from the group consisting of groups represented by the following groups:

$$-O-R-(OH)_z,\ -NH-R-(OH)_z,\ -NR-R-(OH)_z \text{ and}$$

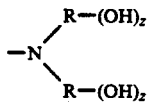

wherein

R is selected from the group consisting of aliphatic, aromatic, heteroaliphatic, heteroaromatic, fused aromatic ring and heteroaromatic ring groups containing up to 10 carbon atoms, and z is from 1 to 10 hydroxyl groups.

As indicated above, x' represents the number of repeat units of uncrosslinked unmodified repeat unit C in the unmodified copolymer of homopolymer, used to blend with the essential modified copolymer of this invention, such that the sum of x' times the repeat unit molecular weight (for every unmodified repeat unit and its x' in the unmodified copolymer or homopolymer) equals a minimum of 10,000 molecular weight units for the unmodified homopolymer or copolymer, and has a maximum molecular weight which is determined when the coating solution viscosity is too high for effective processing into a uniform coherent blocking layer coating. The mole percent of x' unmodified vinyl hydroxy ester or vinyl hydroxy amide repeat units from all sources (the unmodified repeat units in the essential modified copolymer and the unmodified repeat units in the optional unmodified homopolymer or copolymer) in a satisfactory transparent blocking layer composition (one polymer component or a blend of polymers) of this invention can be very large while still obtaining at least satisfactory adhesion at the charge generator layer-blocking layer interface. For example, Device 2 in Table IA in Example II has excellent adhesion when 97.5 mole percent of the blocking layer composition is comprised of unmodified repeat units; that is only 2.5 mole percent of all the repeat units in the blocking layer composition are modified. Preferably the blocking layer of this invention contains at least about 0.5 mole percent modified repeat unit from the essential, one or more, modified copolymer sources and up to about 99.5 mole percent of unmodified repeat unit from the optional, one or more, unmodified homopolymer or copolymer sources for securing high adhesion of at least 10 grams/cm in adhesion peel tests at the charge generator-blocking layer interface.

The upper (mole percent modified repeat unit content) end of the preferred range is as previously defined for a modified copolymer or blend of modified copolymers. Thus, for a blocking layer composition containing one or more modified vinyl hydroxy ester or vinyl hydroxy amide copolymers blended with one or more unmodified vinyl hydroxy ester or vinyl hydroxy amide copolymers or homopolymers, the upper modified repeat unit content limit will again be defined as that amount, which when exceeded, causes the device electrical properties to deteriorate to an unsatisfactory level for the intended machine application due to interlayer mixing caused by too much modified copolymer in the blocking layer composition. A suitable numerical value previously given to this preferred upper limit of modified vinyl hydroxy ester or vinyl hydroxy amide repeat units in a modified copolymer is 75 mole percent (in any given copolymer not in the entire blocking layer composition), when only a modified copolymer or a blend of modified copolymer were used as the entire blocking layer composition. With one or more optional unmodified homopolymers or copolymers also blended into the blocking layer composition with the one or more essential modified vinyl hydroxy ester or vinyl hydroxy amide copolymers, the total number of modified repeat units is preferably between about 0.5 mole percent about 50 mole percent and the total number of unmodified repeat units is preferably between about 50 mole percent and about 99.5 mole percent. It is imperative, however, that at least one of the essential one or more modified copolymers, used with one or more optional unmodified homopolymers or copolymers also blended into the blocking layer composition with the one or more essential modified vinyl hydroxy ester or vinyl hydroxy amide copolymers, or in any other blended or non-blended blocking layer compositions described in this invention, have a minimum of 21 mole percent modified repeat units up to a maximum of about 75 mole percent modified repeat units in the modified copolymer in order to achieve the preferred level of adhesion improvement, that is to at least 10 grams/cm peel strength.

The vinyl hydroxy ester or vinyl hydroxy amide polymer containing unmodified repeat unit C may be a homopolymer or a copolymer wherein the copolymer is defined as any polymer having 2 or more different repeat units which also includes terpolymers. Such polymers containing unmodified repeat unit C, if present as part of a blend with the chemically modified copolymer, are often a homopolymer of 100 percent unmodified repeat unit A. Such polymers containing unmodified repeat unit C may be unique and have a composition different from that of Repeat Unit A in which one or more of R', R'', R''' and X or X' will be different from the R', R'', R''' and X in repeat unit A. The unmodified repeat unit C, if part of an unmodified copolymer containing vinyl hydroxy ester and/or vinyl hydroxy amide repeat units, may also comprise non vinyl hydroxy ester and/or amide repeat units.

Generally, if non-vinyl hydroxy ester and/or non-vinyl hydroxy amide repeat units are included in the blocking layer composition, these repeat units and the unmodified vinyl hydroxy ester and/or vinyl hydroxy amide repeat units, that must be included, should be copolymerized together from their respective monomers. However, if non-vinyl hydroxy ester and/or non-vinyl hydroxy amide repeat units are included with modified vinyl hydroxy ester and/or vinyl hydroxy amide repeat units in the same copolymer of the blocking layer composition, then the copolymer can either be formed from monomers or can be formed by chemical modification of the nucleophilic hydroxyl groups ( in the corresponding unmodified vinyl hydroxy ester and/or vinyl hydroxy amide repeat units) by an appropriate electrophile. A variety of vinyl monomers can be copolymerized with either the unmodified or modified vinyl hydroxy ester and/or vinyl hydroxy amide monomers.

These include styrene and its derivatives, vinyl acetate, acrylonitrile and methacrylonitrile, N-vinylpyrrolidone, all the acrylics including methyl, ethyl, propyl, butyl and 2-ethylhexyl acrylates and methacrylates, acrylic and methacrylic acid, acrylamide and methacrylamide and all their derivatives including N-methyl, N,N-dimethyl and the N-isobutoxymethyl derivative and the like. Additional conjugated monomers include butadiene, isoprene, chloroprene and the like. Some fluorine containing monomers that also may be copolymerizable with either the unmodified or modified vinyl hydroxy ester and/or vinyl hydroxy amide monomers include tetrafluoroethylene, vinylidene fluoride, vinyl fluoride, and 2-(N-ethylperfluorooctanesulfonamide) ethyl acrylate or methacrylate and the like. The number (mole percent) of non-vinyl hydroxy ester and/or non-vinyl hydroxy amide repeat units in copolymers also containing modified and/or unmodified vinyl hydroxy ester and/or vinyl hydroxy amide repeat units will have an upper limit value that is determined by whether the copolymer is miscible with the other polymers in the blocking layer composition, which upper limit value is variable and unpredictable and a function of the chemical structure of the non-vinyl hydroxy ester and/or non-vinyl hydroxy amide repeat units in said copolymer. The lower limit value of the non-vinyl hydroxy ester and/or non-vinyl hydroxy amide repeat units in the copolymer probably has no significance and is about 0.5 mole percent. In addition, the copolymer (described in the preceding sentence) in the blocking layer composition should provide a satisfactory (at least up to about 5 grams/cm peel strength) improvement in adhesion to the selected charge generator layer binder material. In addition, many blocking layer copolymers containing appreciable amounts of non-vinyl hydroxy ester and/or non-vinyl hydroxy amide repeat units may become too soluble in subsequently used coating solvents resulting in interlayer mixing and unacceptable electrical properties; so the mole percentage of the repeat units must be carefully monitored to avoid this problem. Occasionally the reverse solubility problem arises—that is the kind and amount of non-vinyl hydroxy ester and/or non-vinyl hydroxy amide repeat units in the blocking layer copolymer needed to obtain transparency and improved adhesion may cause the copolymer to become too insoluble in commonly used blocking layer coating solvents, making the blocking layer composition non-processable and therefore useless. Transparent blocking layers in belts containing mostly transparent substrates and conductive layers are a preferred embodiment. Generally, a transparent or non-transparent blocking layer can be used on drum electrophotographic devices providing that the blocking layer has the required electrical, adhesive, and solvent barrier properties.

Other examples of miscible polymers include polyethyloxazoline (available from Dow Chemical Company) and any other sufficiently basic organic polymers capable of forming strong H-bonding complexes with vinyl hydroxy ester and/or vinyl hydroxy amide repeat units in the essential modified copolymer blocking layer component of the blocking layer composition so that visual phase separation or immiscibility is inhibited. It is believed that these basic organic polymers would include poly(ethylene and propylene) imines and other organic nitrogen containing basic polymers and the like, but not poly(vinylpyridines).

Since quantitative or near quantitative modification of high molecular weight vinyl hydroxy ester and/or vinyl hydroxy amide polymers is difficult to achieve, the chemically modified blocking layer copolymers and homopolymers having between about 75 and about 100 percent modified repeat units are best arrived at by carrying out the appropriate chemical modification on the vinyl hydroxy ester and/or amide monomer(s) followed by homopolymerization or copolymerization thereof. The resulting modified polymer will be a modified homopolymer if there is only one monomer that is modified with one modifier; or the resulting modified polymer will be a modified copolymer if one or more modified monomers, modified with one or more different modifiers, is copolymerized with one or more unmodified or modified monomers. Chemically modified copolymers, having a modification level less than about 75 mole percent of the vinyl hydroxy ester and/or vinyl hydroxy amide repeat units, are best arrived at by chemically modifying at the nucleophilic hydroxyl site with an appropriate modifying electrophile. Since the highest preferred vinyl hydroxy ester and/or vinyl hydroxy amide copolymer modification level described in the examples of this invention was less than about 75 mole percent, the polymer modification route was employed as a synthetic route to the copolymers in this invention, but this is not intended to be limiting in any way which means that the monomer modification route could optionally have been used.

Other blocking layer composition embodiments of this invention include:

(1) Those blocking layer compositions which contain one or more partially modified vinyl hydroxy ester and/or vinyl hydroxy amide copolymers (the essential component), and one or more (100 percent) completely (therefore made by the monomer modification route only) modified vinyl hydroxy ester and/or vinyl hydroxy amide homopolymers or copolymers. The satisfactory compositional range is again defined in terms of mole percent repeat units from all polymeric sources in the blocking layer composition, i.e. the amount of all modified repeat units is between about 21 mole percent and about 75 mole percent. When blocking layer compositions are selected near the lower modified repeat unit end of the range, the modified vinyl hydroxy ester and/or vinyl hydroxy amide repeat unit, in the one or more essential modified copolymers, should comprise at least about 0.5 mole percent of all the modified repeat units in the blocking layer composition with the remainder of the modified repeat units coming from the 100 percent modified polymeric components. The range for all unmodified repeat units in the blocking layer composition is preferably between about 25 and about 79 mole percent. As in all blocking layer compositions of this invention, at least one of the plurality modified copolymers comprises between about 21 mole percent and about 75 mole percent modified repeat units.

(2) Those blocking layer compositions which contain one or more partially modified vinyl hydroxy ester and/or vinyl hydroxy amide copolymers (the essential component), and one or more (100 percent) completely modified vinyl hydroxy ester and/or vinyl hydroxy amide homopolymers or copolymers, and one or more completely (100 percent) unmodified vinyl hydroxy ester and/or vinyl hydroxy amide homopolymers or copolymers. Usually each 100 percent polymer in the previous sentence will be comprised of some of the same repeat units that make up the essential polymeric component, but this not always necessarily so. A satisfactory range for all modified repeat units is between about 0.5 mole percent and about 75 mole percent, with the modified repeat units in the one or more essential modified copolymers comprising at least about 0.5 mole percent of all the modified repeat units in the blocking layer composition. This restriction is applicable to all the blocking layer compositions in this invention because the one or more essential modified copolymers homogenize or compatibilize the totally modified or totally unmodified homopolymers or copolymers, resulting in the preferred level of blocking layer miscibility that allows reproduceable backside exposure and photoreceptor use. When greater than about 75 percent of the total number of vinyl hydroxy ester or vinyl hydroxy amide repeat units are chemically modified, the interlayer mixing problem sets in and causes the electrical properties of the device to degrade to an undesirable level. Optimum adhesion improvement is achieved when between about 30 mole percent and about 50 mole percent of the total number of vinyl hydroxy ester or vinyl hydroxy amide repeat units in the copolymer are chemically modified. The polymer blends in the blocking layer may comprise between about 0.5 mole percent and about 75 mole percent of chemically modified repeat units and between about 99.5 mole percent and about 25 mole percent nonchemically modified repeat units, based on all the repeat units in the charge blocking layer. The weight percent values will vary depending upon what the hydroxyl modifying unit (O-Z) selected.

Typical optimum adhesive blocking layer compositions containing an optimum level of modified copolymer and unmodified homopolymer blends include:

A. 30 mole percent benzoate ester of poly (2-hydroxyethyl methacrylate) and poly (2-hydroxyethyl methacrylate) [P(HEMA) benzoate ester+P(HEMA)].

B. 30 mole percent benzoate ester of poly (2-hydroxyethyl methacrylate) and poly (2-hydroxyethylacrylate) [P(HEMA) benzoate ester+P(HEA)].

C. 30 mole percent benzoate ester of poly (2-hydroxyethyl acrylate) and poly (2-hydroxyethyl acrylate) [P(HEA) benzoate ester+P(HEA)].

D. 30 mole percent benzoate ester of poly (2-hydroxyethyl acrylate) and poly (2-hydroxyethyl methacrylate) [P(HEA) Benzoate ester+P(HEMA)].

E. 30 mole percent benzoate ester of poly (2-hydroxypropyl methacrylate) and poly (2-hydroxyethyl methacrylate) [P(HPMA) benzoate ester+P(HEMA)].

F. 30 Mole percent benzoate ester of poly (2-hydroxypropyl methacrylate) and poly (2-hydroxyethyl acrylate) [P(HPMA) benzoate ester+P(HEA)].

G. 30 mole percent benzoate ester of poly (2-hydroxypropyl methacrylate) and poly (2-hydroxypropylmethacrylate) [P(HPMA) benzoate ester+P(HPMA)].

H. 30 mole percent benzoate ester of poly (2-hydroxyethyl acrylate) and poly (2-hydroxypropyl methacrylate) [P(HEA) Benzoate ester+P(HPMA)].

I. 30 mole percent benzoate ester of poly (2-hydroxyethyl methacrylate) and poly (2-hydroxypropyl methacrylate) [P(HEMA) benzoate ester and P(HPMA)].

The above unmodified homopolymers are mixed with the chemically modified benzoate ester copolymer, the essential modified copolymer blocking layer component, in a solution wherein the unmodified repeat units in the unmodified homopolymer or copolymer comprise in these optimum blocking layer compositions between about 70 mole percent and about 95 mole percent and the modified benzoate ester repeat units in the modified copolymer comprise between about 5 mole percent and about 30 mole percent of all the repeat units in the blocking layer composition. Such a blocking layer coating is then fabricated by any suitable conventional process.

Other typical optimum modified copolymer-unmodified homopolymer blends comprising the blocking layers of this invention include the 30 mole precent benzoate ester of poly (2-hydroxypropyl acrylate) [P(HPA)] with the unmodified homopolymer poly (2-hydroxypropyl acrylate) [P(HPA)], or with the unmodified homopolymer poly (2-hydroxypropyl methacrylate) [P(HPMA)], or with the unmodified homopolymer poly (2-hydroxyethyl acrylate) [P(HEA)], or with the unmodified homopolymer poly (2-hydroxyethyl methacrylate) [P(HEMA)]. It should be understood that the unmodified homopolymer component could also comprise blends of the above unmodified homopolymers, or could comprise copolymers or blends thereof containing the repeat units named in the above unmodified homopolymers. Similarly the modified copolymer component could also comprise blends of the above named modified copolymers, and could contain one or more different modified repeat units and unmodified repeat units. Similarly, the modified vinyl hydroxy ester and/or vinyl hydroxy amide copolymers could contain acetate esters or other esters such as those derived from monofunctional aromatic carboxylic acid chlorides listed as Z-X" reactants above which could be blended with unmodified polymers. Also phenylurethanes of these vinyl hydroxy ester containing polymers may be blended with unmodified polymers.

Typical unmodified polymers include the numerous unmodified vinyl hydroxy ester polymers and vinyl hydroxy amide polymers listed above.

Typical optimum adhesive blocking layer compositions containing modified copolymer-modified copolymer type blends include:

A. 30 mole percent benzoate ester of poly (2-hydroxyethyl methacrylate) and 30 mole percent benzoate ester of poly (2-hydroxyethyl acrylate) [P(HEMA) benzoate ester+P(HEA) benzoate ester].

B. 30 mole percent benzoate ester of poly (2-hydroxyethyl methacrylate) and 30 mole percent benzoate ester of poly (2-hydroxypropyl methacrylate) [P(HEMA) benzoate ester and P(HPMA) Benzoate ester].

C. 30 mole percent benzoate ester of poly (2-hydroxyethyl methacrylate) and 30 mole percent acetate ester of poly (2-hydroxyethyl methacrylate) [P(HEMA) benzoate ester and P(HEMA) acetate ester].

D. 30 mole percent benzoate ester of poly (2-hydroxyethyl methacrylate) and 30 mole percent acetate ester of poly (2-hydroxyethyl acrylate) [P(HEMA) benzoate ester and P(HEA) acetate ester].

E. 30 mole percent benzoate ester of poly (2-hydroxyethyl acrylate) and 30 mole percent acetate ester of poly (2-hydroxyethyl acrylate) [P(HEA) benzoate ester and P(HEMA) acetate ester].

F. 30 mole percent benzoate ester of poly (2-hydroxyethyl methacrylate) and 30 mole percent acetate ester of poly (2-hydroxypropyl) methacrylate [P(HEMA) benzoate ester & P(HPMA) acetate ester].

G. 30 mole percent acetate ester of poly (2-hydroxyethyl methacrylate) and 30 mole percent benzoate ester of poly (2-hydroxypropyl methacrylate) [P(HEMA) acetate ester and P(HPMA) benzoate ester].

H. 30 mole percent acetate ester of poly (2-hydroxyethyl methacrylate) and 30 mole percent acetate ester of poly (2-hydroxyethyl acrylate) [P(HEMA) acetate ester and P(HEA) acetate ester].

I. 30 mole percent acetate ester of poly (2-hydroxyethyl methacrylate) and 30 mole percent acetate ester of poly (2-hydroxypropyl methacrylate) [P(HEMA) acetate ester and P(HPMA) acetate ester].

Other typical optimum adhesive blocking layer compositions containing modified copolymer-modified copolymer blend combinations include poly (2-hydroxypropyl acrylate) [P(HPA)] benzoate and acetate esters combined with P(HEMA), P(HPMA) and P(HEA) benzoate and acetate esters].

Typical optimum adhesive blocking layer compositions containing blends involving terpolymers include:

Terpolymer I: Poly [(2-hydroxyethyl methacrylate), (2-hydroxyethylacrylate), (2-hydroxypropyl methacrylate)][P(HEMA)+P(HEA)+P(HPMA)] wherein the maximum single repeat unit content is 80 mole percent and the minimum 10 mole percent.

Terpolymer II: Same as Terpolymer I, but randomly modified so that 30–50 mole percent of the total repeat unit content is hydroxyl modified as the benzoate ester.

Terpolymer III: Same as Terpolymer I, but randomly modified so that 30–50 mole percent of the total repeat unit content is hydroxyl modified as the acetate ester.

Terpolymer IV: Same as Terpolymer I but randomly modified so that 30 mole percent of the total repeat unit content is hydroxyl modified as the benzoate ester and another 20 mole percent is modified as the acetate ester.

Terpolymer V: Same as Terpolymer I, but randomly modified so that 30 mole percent of the total repeat unit content is hydroxyl modified as the benzoate ester and another 20 mole percent is modified as the phenyl urethane.

The foregoing terpolymers may be mixed in all ten combinations [e.g. I and II, I and III, I and IV, I and V, II and III, II and IV, II and V, III and IV, III and V, and IV and VI] with each other to achieve desired adhesive-blocking layer properties including insolubility in subsequently used coating compositions, at least satisfactory peel test adhesion of greater than about 5 g/cm at the blocking layer-charge generator layer interface, and stable cyclic electrical properties. Moreover, these terpolymers may also be combined with any of the previously defined copolymers and homopolymers to provide the desired adhesive-blocking layer properties.

MONOFUNCTIONAL ELECTROPHILE

The uncrosslinked vinyl hydroxy ester or vinyl hydroxy amide polymer may be chemically modified at a nucleophilic hydroxyl group by any suitable monofunctional electrophile. The expression "monofunctional electrophile" as employed herein is defined as either a non-polymeric molecular species which contains one group [X" as an atom or group of atoms] that is easily displaceable (usually as the leaving group HX") by the nucleophilic hydroxyl group of the vinyl hydroxy ester and/or vinyl hydroxy amide containing polymer or copolymer; or as a non-polymeric molecular species which contains a site of unsaturation (Z in some examples) across which is readily added the nucleophilic hydroxyl group of the vinyl hydroxy ester and/or vinyl hydroxy amide containing polymer or copolymer to give OZH. The modified copolymer products of the above described chemical reactions can be used as one of the essential modified copolymers in the adhesive-blocking layer compositions of this invention. The same monofunctional electrophiles may also modify, in like manner, a vinyl hydroxy ester or a vinyl hydroxy amide monomer which can then be subsequently polymerized or copolymerized to give a modified homopolymer or copolymer to be used in the adhesive-blocking layer compositions of this invention. Typical classes of Z-X" reactants or monofunctional electrophile modifiers of vinyl hydroxy ester and/or amide polymers include: carboxylic acid chlorides, carboxylic acid anhydrides, isocyanates of various kinds, sulfonyl chlorides, alkyl halides, activated aryl halides, activated esters, and other active compounds including halides of silicon, phosphorus, selenium, boron and any other suitably reactive monofunctional heteroatom halides, and the like. Heteroatoms may also coexist in these non-cyclic and cyclic reactants in chemically inert locations of the structural formula. The chemically modified polymer of this invention should be uncrosslinked and solvent soluble so that is can be applied as a coating with the aid of a solvent or, if desired, blended with another polymer. Thus reactions with difunctional (or higher polyfunctionality) compounds should be avoided so that the chemically modified polymer does not crosslink. Z-X" and are Z both considered monofunctional electrophiles because they both undergo modifying chemical reactions with nucleophiles, like the hydroxyl group, in vinyl hydroxy ester and/or vinyl hydroxy amide containing polymers and monomers. However, the Z reactant can be a monofunctional electrophile via two different reaction pathways versus the Z-X" reactant which is a monofunctional electrophile via only one reaction pathway. In one form of Z monofunctional electrophile, Z is an unsaturated site in a non-polymeric molecule in which no leaving group is displaced because the nucleophilic hydroxyl group adds to, and does not displace the unsaturation site Z; and in the second form of Z monofunctional electrophile, Z is part of a ring structure which undergoes ring opening when the nucleophilic hydroxyl group displaces the Z group. In this case however the displaced leaving group remains attached to the hydroxyl group and therefore to the resulting modified copolymer or monomer. With Z-X' monofunctional electrophiles, the X" leaving group is always split off from the modified copolymer or monomer.

The Z reactants or monofunctional electrophile modifiers of vinyl hydroxy ester and/or amide polymers are more diversified than the Z-X" reactants, and are best classified into two categories: (1) cyclic or non-cyclic unsaturated compounds, which may or may not contain heteroatoms in the unsaturated linkage or in chemically inert locations of the structural formula, that add the nucleophilic hydroxyl group at the most reactive unsaturated linkage and (2) carbocyclic and heterocyclic compounds that readily undergo ring opening reactions at the heteroatom site or elsewhere in the structural formula of these cyclic compounds. Unsaturated sites may or may not be involved in the ring opening process Typical examples of Z-X" reactants or modifiers that undergo nucleophilic displacement of the X" group by the hydroxyl group in vinyl hydroxy ester and/or amide polymers include: carboxylic acid chlorides such as acetyl chloride, benzoyl chloride, 4-biphenylcarbonyl cloride, 4-p-terphenylcarbonyl chloride, 1-naphthoyl chloride, 2-furoyl chloride, 2-thiophenecarbonyl chloride, 4-pyridinecarbonyl chloride, 4-chloropyridine hydrochloride, ethyl chloroformate, phenyl chloroformate, acroyl chloride, methacroyl chloride; carboxylic acid anhydrides such as acetic anhydride, benzoic anhydride, lauric anhydride, and trifluoroacetic anhydride; sulfonyl chlorides such as methanesulfonyl chloride, p-toluenesulfonyl chloride, 2-thiophenesulfonyl chloride and trifluoromethanesulfonyl chloride; alkyl halides such as allyl chloride, ally bromide, benzyl chloride, benzyl bromide, methallyl chloride, butyl iodide, neopentyl iodide, iodoacetic acid, iodoacetonitrile, iodoacetamide, chloroacetone, 2-chloroacetophenone and N-(bromomethyl) phthalimide; activated aryl halides such as 2-chlorobenzoxazole, 2-chlorobenzothiazole, 4-chloro-2,6-diaminopyrimidine, 2-chloro-4,6-diamino-1,3,5-triazine, 3-chloro-2,5-dimethylpyrazine; activated esters such as N-acryloxysuccinlmide, 3-maleimidobenzoic acid H-hydroxysuccinimide, (2-naphthoxy) acetio acid N-hydroxysuccinimide and N-hydroxysuccinimidyl acetoacetate; active nitrogen heterocyclic compounds such as 1-acetylimidazole, 1-(p-toluenesulfonyl) imidazole, 1-(mesitylenesulfonyl) imidazole, 1-(trimethylsilyl) imidazole, 2-trimethylsilyl-1,2,3-triazole, 1-(p-toluenesulfonyl)-2-pyrrolidinone, 1-(trimethylsilyl) pyrrolidine; halides of silicon such as dimethylphenylsilyl chloride and numerous other monofunctional Si-Cl compounds; active compounds of phosphorus such as 1,2-phenylene phosphorochloridate and 1,2-phenylene phosphorochloridite; active compounds of boron such as B-bromocatecholborane; active iminium compounds such as imidoyl halides, imidate salts and iminium salts; miscellaneous active compounds of selenium; and the like.

Common examples of Z reactants or modifiers that undergo nucleophilic addition by the hydroxyl group in vinyl hydroxy ester and/or amide polymers include:

Category (1): butyl isocyanate, phenyl isocyanate, phenyl isothiocyanate, benzenesulfonyl isocyanate, N,N-dimethylacrylamide, N-vinylpyrrolidone, acrylonitrile, other sufficiently activated vinyl and $\alpha$ and $\beta$ unsaturated compounds, sulfines such as N-thionylaniline and sulfenes generated from a sulfonyl chloride and tertiary amine such as N-sulfonylaniline or methylene sulfene, and the like.

Category (2): succinic anhydride, phthalic anhydride, maleic anhydride, isatoic anhydride, N-methylisatoic anhydride, itaconic anhydride, 2,3-pyridenedicarboxylic anhydride, methyl-5-norbornene-2,3-dicarboxylic anhydride, 1,8-naphthoic anhydride, 2-sulfobenzoic acid anhydride, styrene oxide, t-butyl glycidyl ether, butadiene monoxide, 1,4-butane sultone, 1,3-propane sultone, 1,8-naphthosultone, $\beta$ propiolactone, 2-methyl-1,3,2-dioxaborinane, diketene and the like.

Some of the above modifiers will function more effectively, that is without crosslinking side reactions and at practical modification reaction rates, for the vinyl hydroxy ester polymers and others for the vinyl hydroxy amide polymers.

All chemically active modifiers (i.e. reactants Z-X" and Z) towards the hydroxyl groups in vinylhydroxy ester and/or amide polymers, on which the polymer hydroxyl group will perform a nucleophilic displacement or addition reaction, should be monofunctionally pure, i.e. greater than about 99.9 percent by weight pure. Non-functional impurities, or impurities that do not react with the hydroxyl groups in vinyl hydroxy ester and/or vinyl hydroxy amide polymers, may coexist with the monofunctional reactant to decrease the overall reactant purity to much less than 99.9 percent. If polyfunctional impurities do exist in the reactant composition, the polyfunctional impurities must be chemically inert under the applied reaction conditions of the chemical modification process. Reactive polyfunctional impurities will crosslink, sometimes immediately and other times over long time periods, the vinyl hydroxy ester and/or amide polymers producing a non solvent processable (insoluble) gel. Strenuous reaction conditions (high temperature for prolonged times) and vigorous catalysts, both or either of which could promote secondary reactions between unmodified hydroxyl groups and modified hydroxyl groups to give a non-processible crosslinked product, should also be avoided.

Hydroxyl group nucleophilic displacement reactions on Z-X" reactants (modifiers) will generally yield a reaction by product which itself has been separated from the modifier (usually as HX") may be volatile or easily washed out of the modified copolymer during isolation thereof. The by product may be removed in its native form or may be combined with a (basic) acid scavenger to be removed as a water soluble organic salt. Hydroxyl group nucleophilic addition reactions on Z reactants (modifiers) generally do not afford a reaction by product which facilitates isolation of pure modified copolymer. In these nucleophilic addition polymer modification reactions, the hydroxyl hydrogen is generally transferred to the attached modified hydroxyl group as -OZH.

Generally, the hydroxyl groups in the polymer are chemically modified (altered) to the total extent of between about 21 percent and about 75 percent of the total number initially present in the polymer prior to chemical modification as described above.

Satisfactory results may be achieved with chemically modified vinyl hydroxy ester or vinyl hydroxy amide polymers having a number average molecular weight of at least about 10,000, the upper limit being limited by the viscosity necessary for processing. Preferably, the weight average molecular weight is between about 20,000 and about 2,000,000. Optimum blocking layer performance is obtained when the weight average molecular weight is between about 100,000 and about 2,000,000.

CHEMICAL REACTION FOR PREPARING CHEMICALLY MODIFIED POLYMERS

A typical chemical reaction for preparing chemically modified vinyl hydroxy ester or vinyl hydroxy amide polymers include:

(1) Nucleophilic Displacement Reactions such as:

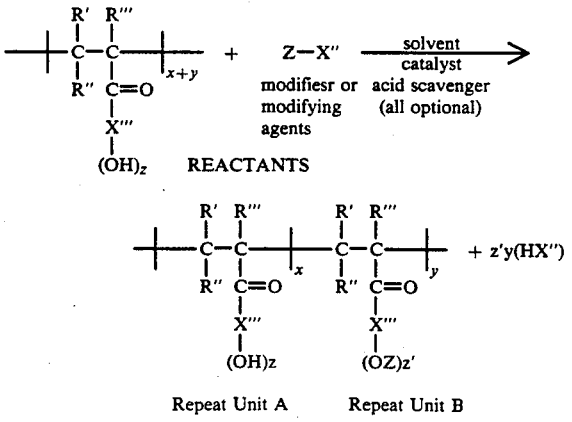

wherein:

X''' is X without the hydroxyl group(s),

Z-X'' is the chemical modifier or modifying agent wherein:

Z is the part of the modifying agent incorporated into the polymer as OZ in repeat unit B and X'' is the remainder of the modifying agent that is removed (evaporated or washed out as is or as an organic salt) from the modification process as HX''.

(2) Nucleophilic Addition Reactions such as:

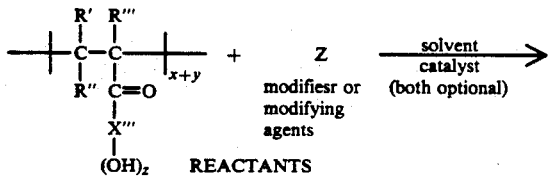

REACTANTS

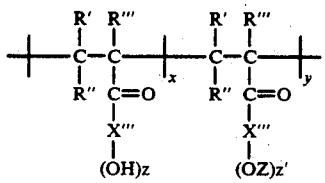

Repeat Unit A Repeat Unit B

MODIFIED COPOLYMER PRODUCT wherein:

X' is X without the hydroxyl group(s),

Z is the chemical modifier or modifying agent which is entirely incorporated into the polymer as OZH in repeat unit B.

Since there is no by product (or leaving group) from this addition modification reaction, only unreacted modifier (if any exists) should be removed from the contents of the modification process.

The uncrosslinked chemically modified polymers of this invention are solvent soluble. Any suitable solvent may be utilized to apply the blocking layer. Typical solvents include methanol, 1-methoxy-2-hydroxypropane, tertiary butyl alcohol, water and mixtures of these solvents with other alcohol solvents and tetrahydrofuran and the like. Choice of solvents depends upon the nature of the conductive layer upon which the barrier layer is applied and also on the properties of the polymers constituting the blocking layer. Appropriate solvents can, in general, be selected based on the known properties of the individual polymers, as is well known in the art. Mixtures of solvents may also be used, if desired. The proportion of solvent to be utilized varies with the type of coating technique to be employed, e.g., dip coating, spray coating, wire wound bar coating, roll coating, and the like so that the viscosity and volatility of the coating mixture is adjusted to the type of coating technique utilized. Generally, the amount of solvent ranges from between about 99.8 percent by weight to about 90 percent by weight, based on the total weight of the coating composition.

Any suitable and conventional coating technique may be employed to apply the blocking layer to the underlying surface. Typical application techniques include spraying, dip coating, roll coating, wire wound rod coating, and the like. The specific composition selected for the ground plane will influence the thickness of the blocking layer selected. Generally, satisfactory results may be achieved with a dried blocking layer coating having a thickness between about 0.05 micrometer and about 8 micrometers on some conductive layers. When the thickness of the layer exceeds about 8 micrometers, the electrophotographic imaging member may show poor discharge characteristics and residual voltage build-up after erase during cycling. A thickness of less than about 0.02 micrometer tends generally to result in pin holes as well as high dark decay and low charge acceptance due to non-uniformity of the thickness of different areas of the blocking layer. The preferred thickness range is between about 0.3 micrometer and about 1.5 micrometers. Optimum hole blocking results are achieved with a thickness of between about 0.2 micrometer and about 1 micrometer on non-metallic electrically conductive layers and between about 0.05 micrometer and about 1 micrometer on electrically conductive metallic surfaces. However, the surface resistivity of the dry blocking layer of the present invention should be greater than about $10^{10}$ ohms/sq as measured at room temperature (25° C.) and one atmosphere pressure under 40 percent relative humidity conditions. This minimum electrical resistivity prevents the blocking layer from becoming too conductive.

After the blocking layer coating is applied, the deposited coating is heated to drive out the solvent and form a solid continuous film. Generally, a drying temperature between about 110° C. and about 135° C. is preferred to minimize any residual solvent, and to minimize any distortion to organic film substrates such as biaxially oriented polyethylene terephthalate. The temperature selected depends to some extent on the specific electrically conductive layer utilized and is limited by the temperature sensitivity of the substrate. The drying temperature may be maintained by any suitable technique such as ovens, forced air ovens, radiant heat lamps, and the like. The drying time depends upon the temperatures used. Thus, less time is required when higher temperatures are employed. Generally, increasing the drying time increases the amount of solvent removed. One may readily determine whether sufficient drying has occurred by chromatographic or gravimetric analysis.

To achieve maximum adhesion between the charge blocking layer and the charge generating layer, the charge generating polymer binder solvent selected for applying the charge generation layer should preferably also at least partially swell the uncrosslinked chemically modified polymers of this invention to introduce or promote polymer-polymer interfacial penetration, but not bulk mixing of the two layers. Thus, the polymers from each layer would be immiscible if coated from a common solvent mixture when the charge generating layer is coated on top of the blocking layer. Only a very small polymer-polymer penetration depth gives improved adhesion. This amounts to mixing of polymer from each of the contacting monolayers to form a thin continuous interfacial polymer mixing zone. Special bonding interactions also play a role in strengthening adhesive forces in the interfacial polymer mixing zone. These special bonding interactions are in part created by hydroxyl group chemical modification of vinyl hydroxy ester and/or vinyl hydroxy amide containing polymers comprising the blocking layer. In this invention the special bonding interactions include hydrogen bonding, dipole-dipole interactions and bonding from aromatic ring Π orbital overlap wherein the latter bonding interaction is generated by benzoylation (modification) of the hydroxyl groups in the blocking layer polymer. Preferably, a common structural feature is shared by the adjacent layer polymers to provide improved adhesion from the interfacial polymer mixing zone. The frequency of the common structural feature [e.g. aromatic group content introduced by benzoylation of the hydroxyl containing blocking layer polymer to form a benzoate ester (aromatic) group] in the blocking layer and charge generating layer polymers is selected (hydroxyl modification fraction in the blocking layer) to provide an interfacial polymer mixing zone. The thickness of the thin continuous interfacial polymer mixing zone is preferably between about 50 angstroms and about 150 angstroms. Thicknesses greater than about 200 angstroms may lead to cyclic electrical failure whereas thicknesses less than about 25 angstroms may exhibit adhesion comparable to embodiments where no interfacial polymer mixing occurs.

When, for example, there is close structural identity between an aromatic group (e.g. alkyl benzoate ester group) in a benzoylated vinyl hydroxy ester of a chemically modified blocking layer polymer of this invention and an aromatic group (e.g. alkyl benzoate ester group) in a polyester binder of an adjacent charge generation layer, an interfacial polymer mixing zone forms between the layers and a very large adhesion improvement (e.g. from less than about 5 g/cm to greater than about 200 g/cm) is realized. A moderate adhesion improvement was found where benzene rings were the common structural identity of polymers in the blocking layer and the generating layer (e.g. substitution of a benzoylated vinyl hydroxy ester of a chemically modified blocking layer polymer for a chemically unmodified blocking layer used in combination with generating layers containing polyvinyl carbazole improved adhesion from less than about 5 g/cm to 23 g/cm). For generating layers containing a polyvinyl butyral binder, the adhesion improvement increased from less than about 5 g/cm to about 10 g/cm with the (benzoylated) modified vinyl hydroxy ester blocking layer polymer. This smaller adhesion improvement is presumably because of the absence of common structural features in the interfacially mixed polymers. It is believed that an interfacial zone formed in which the modified vinyl hydroxy ester polymer from the blocking layer and the polyvinyl carbazole from the generating layer occurred to cause the large adhesion improvement observed.

Any suitable solvent may be utilized to apply the generating layer. Typical solvents include methylene chloride, 1,2-dichloroethane, 1,1,2-trichloroethane, toluene, tetrahydrofuran, cyclohexanone, methyl ethyl ketone, and the like. Generally, the solvent utilized to apply the generator layer should swell the surface of the blocking layer to ensure the formation of an interfacial zone between the blocking layer and the generating layer, the interfacial zone containing a mixture of polymers from both the blocking layer and the generating layer. The expression "swelling" as employed herein is defined as partial solubility of a cluster of polymer chains wherein the solvent is not sufficiently strong enough to surround each individual polymer chain, and so the solvent only surrounds clusters of polymer chains on all sides or on less than all sides of the cluster. Thus, only the outside polymer chains of the cluster in contact with the solvent become somewhat mobile in their partial dissolution state, but this mobility is sufficient to cause a significant amount of interlayer polymer-polymer contact with special bonding interactions, and the resulting mixing zone wherein the polymer-polymer contact occurs results in greatly improved adhesion.

Any suitable and conventional coating technique may be employed to apply the generating layer to the blocking layer.

Generally, as described above and hereinafter, the electrophotoconductive imaging member of this invention comprises a supporting substrate layer having an electrically conductive surface, a vinyl hydroxy ester and/or a vinyl hydroxy amide polymer (with greater than about 20 mole percent modified repeat units) containing blocking layer and a photoconductive imaging layer. The photoconductive layer may comprise any suitable photoconductive material well known in the art. Thus, the photoconductive layer may comprise, for example, a single layer of a homogeneous photoconductive material or photoconductive particles dispersed in a binder, or multiple layers such as a charge generating overcoated with a charge transport layer. The photoconductive layer may contain homogeneous, heterogeneous, inorganic or organic compositions. One example of an electrophotographic imaging layer containing a heterogeneous composition is described in U.S. Pat. No. 3,121,006 wherein finely divided particles of a photoconductive inorganic compound are dispersed in an electrically insulating organic resin binder. The entire disclosure of this patent is incorporated herein by reference. Other well known electrophotographic imaging layers include amorphous selenium, halogen doped amorphous selenium, amorphous selenium alloys including selenium arsenic, selenium tellurium, selenium arsenic antimony, and halogen doped selenium alloys, cadmium sulfide and the like.

This invention is particularly desirable for electrophotographic imaging layers which comprise two electrically operative layers, a charge generating layer and a charge transport layer.

Any suitable charge generating or photogenerating material may be employed as one of the two electrically operative layers in the multilayer photoconductor embodiment of this invention. Typical charge generating materials include metal free phthalocyanine described in U.S. Pat. No. 3,357,989, metal phthalocyanines such as copper phthalocyanine, vanadyl phthalocyanine, selenium containing materials such as trigonal selenium, bisazo compounds, quinacridones, substituted 2,4-diaminotriazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. Nos. 4,265,990, 4,233,384, 4,471,041, 4,489,143, 4,507,480, 4,306,008, 4,299,897, 4,232,102 4,233,383, 4,415,639 and 4,439,507. The disclosures of these patents are incorporated herein by reference in their entirety.

Any suitable inactive resin binder material may be employed in the charge generator layer. Typical organic resinous binders include polycarbonates, acrylate polymers, vinyl polymers, cellulose polymers, polyesters, polysiloxanes, polyamides, polyurethanes, epoxies, and the like. Many organic resinous binders are disclosed, for example, in U.S. Pat. Nos. 3,121,006 and 4,439,507, the entire disclosures of which are incorporated herein by reference. The photogenerating composition or pigments is present in the resinous binder composition in various amounts. When using an electrically inactive or insulating resin, it is essential that there be particle-to-particle contact between the photoconductive particles. This necessitates that the photoconductive material be present in an amount of at least about 15 percent by volume of the binder layer with no limit on the maximum amount of photoconductor in the binder layer. If the matrix of binder comprises an active material, e.g. poly-N-vinylcarbazole, the photoconductive material need only to comprise about 1 percent or less by volume of the binder layer with no limitation on the maximum amount of photoconductor in the binder layer. Generally for charge generator layers containing an electrically active matrix or binder such as polyvinyl carbazole or phenoxy resin [poly(hydroxyether)], from about 5 percent by volume to about 60 percent by volume of the photogenerating pigment is dispersed in about 40 percent by volume to about 95 percent by volume of binder, and preferably from about 7 percent to about 30 percent by volume of the photogenerating pigment is dispersed in from about 70 percent by volume to about 93 percent by volume of the binder The specific proportions selected also depends to some extent on the thickness of the generator layer. The thickness of the photogenerating binder layer is not particularly critical. Layer thicknesses from about 0.05 micrometer to about 40 micrometers have been found to be satisfactory. The photogenerating binder layer containing photoconductive compositions and/or pigments, and the resinous binder material preferably ranges in thickness of from about 0.1 micrometer to about 5 micrometers, and has an optimum thickness of from about 0.3 micrometer to about 3 micrometers for best light absorption and improved dark decay stability and mechanical properties.

The active charge transport layer may comprise any suitable transparent organic polymer or non-polymeric material capable of supporting the injection of photogenerated holes and electrons from the charge generation layer and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 Angstroms to 8000 Angstroms. Therefore, the charge transport layer is substantially transparent to radiation in a region in which the photoconductor is to be used. Thus, the active charge transport layer is a substantially non-photoconductive material which supports the injection of photogenerated holes or electrons from the generation layer. The active transport layer is normally transparent when exposure is effected through the active layer to ensure that most of the incident radiation is utilized by the underlying charge carrier generator layer for efficient photogeneration. The charge transport in conjunction with the generation layer in the instant invention is a material which is an insulator to the extent that an electrostatic charge placed on the transport layer is not conductive in the absence of illumination, i.e. does not discharge at a rate sufficient to prevent the formation and retention of an electrostatic latent image thereon.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

An especially preferred transport layer employed in one of the two electrically operative layers in the multilayer photoconductor embodiment of this invention comprises from about 25 to about 75 percent by weight of at least one charge transporting aromatic amine compound, and about 75 to about 25 percent by weight of a polymeric film forming resin in which the aromatic amine is soluble. These charge transporting materials are well known in the art as are the binders and techniques for applying the layers. Generally, the thickness of the transport layer is between about 5 micrometers to about 100 micrometers, but thicknesses outside this range can also be used. In general, the ratio of the thickness of the charge transport layer to the charge generator layer is preferably maintained from about 2:1 to 200:1 and in some instances as great as 400:1.

If desired, the charge transport layer may comprise any suitable electrically active charge transport polymer instead of a charge transport monomer dissolved or dispersed in an electrically inactive binder. Electrically active charge transport polymer employed as charge transport layers are described, for example in U.S. Pat. Nos. 4,806, 443, 4,806,444, and 4,818,650, the entire disclosures thereof being incorporated herein by reference.

Optionally, an overcoat layer may also be utilized to improve resistance to abrasion. In some cases a back coating may be applied to the side opposite the photoreceptor to provide flatness and/or abrasion resistance. These overcoating and backcoating layers may comprise organic polymers or inorganic polymers that are electrically insulating or slightly semi-conductive as is well known in the art.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE 1

Chemical Modification of A Vinyl Hydroxy Ester Containing Polymer

Part A: Chemical Modification of Poly (2-hydroxyethyl methacrylate) With Benzoyl Chloride To a 3 liter 3-neck round bottom flask equipped with a mechanical stirrer, argon inlet and outlet tube, and a water condenser was charged 2000 grams of N,N-dimethylformamide (solvent), 87.3 grams (0.863 mole) triethylamine (acid scavenger) and 19.54 grams (0.160 mole) 4 dimethylaminopyridine (catalyst). To this rapidly stirred solution at room temperature and under an argon flow was added, 200 grams [1.54 mole of poly (2-hydroxyethyl methacrylate) P(HEMA) repeat units] of high molecular weight P(HEMA), and after 5 hours stirring a viscous P(HEMA) solution (~9 weight percent) remained. The unmodified P(HEMA) had a Mw of $1.0-1.4\times10^6$, and an intrinsic viscosity [η] of about 0.65 dl/g measured in methanol at 25° C., and was obtained from Scientific Polymer Products. The unmodified P(HEMA) had an intrinsic viscosity in the range of 1.85-2.15 dl/g (wherein the intrinsic viscosity was obtained in dimethylformamide solvent at 30° C.). The viscosity average molecular weight for this intrinsic viscosity range is about 955,000 to 1,180,000 as obtained from the Mark-Houwink relationship in which the constants are $K=8.9\times10^{-5}$ and $a=0.72$. The viscosity average molecular weight is generally about 10 percent less that the weight average molecular weight at a given intrinsic viscosity value, and the weight average molecular weight is generally 2 to 3 times the number average molecular molecular weight.

To the stirred viscous polymer solution at room temperature was dropwise added 110.29 g (0.785 mole) of benzoyl chloride and the resulting solution was allowed to stir under ambient conditions overnight. Finally the polymer solution was coagulated into 10 liters of mechanically stirred deionized water. The precipitated polymer was filtered and then slurried several times with deionized water until the final filtrate had a low conductivity value (≦50 micromhos or microsiemens) as measured with a model II Nester Micromho Pen TM. The moist modified copolymer was dried at 40° C. overnight in either an air convection oven or a vacuum oven at about 0.5 mm Hg. $^1$H-NMR analysis of the dried modified polymer was obtained in DMSO-$d_6$ solution (5 weight percent) using a Bruker AM-360 system equipped with a 5 mm QNP probe. Proton data were accumulations of 16 transients at room temperature, using a recycle delay between 30 degree pulses of 4.5 seconds total. A trace amount of tetramethylsilane was added to the NMR solution as an internal standard (chemical shift reference). The average modified and unmodified repeat unit content per polymer chain was calculated from a direct comparison between the normalized signal intensities of the benzoate ester phenyl group (7.4-8.1 ppm multiplet) in the modified P(HEMA) repeat units, and the hydroxyl hydrogen (4.75 ppm singlet) in the unmodified P(HEMA) units. In this modification reaction, the average P(HEMA) benzoate ester content was about 30-31 percent of the total repeat units per polymer chain which indicates about 60 mole percent of the charged benzoyl chloride became attached to the P(HEMA)hydroxyl groups. The other 40 mole percent of charged benzoyl chloride was consumed by the (about 3 weight percent) water present in the unmodified P(HEMA) used as the starting material in this polymer modification reaction. Reaction by products, excess reactants, and catalyst were removed in the deionized water slurries.

Part B: Chemical Modification of Poly (2-hydroxyethyl methacrylate) With Acetic Anhydride To a 3 liter 3 neck round bottom flask equipped with a mechanical stirrer, argon inlet tube and outlet tube, and a water condenser was charged 1500 grams of N,N-dimethylformamide solvent, 40.58 grams (0.40 mole) triethylamine and 9.77 grams (0.08 mole) of 4-dimethylaminopyridine. The reaction vessel was transferred to a water bath at 50° C. and with rapid stirring under an argon flow, 100 g (0.68 mole repeat units) of high molecular weight P(HEMA) [same P(HEMA) as described in Part A] was added and allowed to dissolve in about 4 hours.

To the stirred warm viscous polymer solution was dropwise added 40.84 grams (0.40 mole) of acetic anhydride and the resulting solution was stirred overnight at 50° C. Finally the polymer solution was coagulated into 10 liters of mechanically stirred deionized water. The precipitated polymer was filtered and was then slurried several times with deionized water until the final filtrate had a low conductivity value (≦50 micromhos or microsiemens) as measured in Part A. The moist modified polymer was dried at 40° C. overnight in either an air convection oven or a vacuum oven at 0.5 mm Hg. A $^1$H-NMR spectrum was obtained as in Part A. The average modified and unmodified repeat unit content per polymer chain was calculated from a direct comparison between the normalized signal intensities of the acetate ester methyl group (2.04 ppm singlet) in the modified P(HEMA) repeat units, and the hydroxyl hydrogen (4.78 ppm singlet) in the unmodified P(HEMA) repeat units. In this chemical modification reaction, the average P(HEMA) acetate ester content was about 53 percent of the total repeat units per polymer chain. Since the charged stoichiometry was for a 72 percent modification level, the NMR analysis is in excellent agreement. Unlike Part A, in which a reactive carboxylic acid chloride was used, the less reactive anhydride is not sacrificed to P(HEMA) bound water and the anticipated modification level results. As in part A, product impurities are removed in the deionized water slurries.

Part C: Chemical Modification of Poly (2-hydroxyethyl methacrylate) With Phenylisocyanate.

To a 1 liter 3 neck round bottom flask equipped with a mechanical stirrer, argon inlet tube and outlet tube, and a water condenser was added 400 grams of N,N-dimethylformamide solvent. The reaction vessel was transferred to a water bath at 50° C. and with rapid stirring under an argon flow, 50 grams (0.384 mole repeat units) of high molecular weight P(HEMA) [same P(HEMA) as described in Part A] was added and allowed to dissolve in about 4 hours at 50° C.

To the stirred warm viscous polymer solution was dropwise added 45.8 grams (0.384 mole) of phenyl isocyanate and the resulting solution was stirred for 4 hours at 50° C. Finally the polymer solution was coagulated into 4 liters of mechanically stirred deionized water. The precipitated polymer was filtered and was then slurried several times with deionized water until the final filtrate had a low conductivity value (≦50 micromhos or microsiemens) as measured in Part A. The moist modified polymer was dried at 40° C. overnight in either an air convection oven or a vacuum oven at 0.5 mm Hg. A $^1$H-NMR spectrum was obtained as in Part A. The average modified and unmodified repeat unit content per polymer chain was calculated from a direct comparison between the normalized signal intensities of the phenyl urethane group (6.8-7.9 ppm multiplet) in the chemically modified P(HEMA) repeat units, and the hydroxyl hydrogen (4.81 ppm singlet) in the unmodified P(HEMA) repeat units. In this modification reaction, the average P(HEMA) phenyl urethane content was about 70 percent of the total repeat units per polymer chain. Since the charged stoichiometery was for a 100 percent modification level, about 30 mole percent of the charged isocyanate was sacrificed to presumably P(HEMA) bound $H_2O$ (about 4 weight percent). Karl Fisher analysis for P(HEMA) water content, as delivered from the vendor, was commonly about 3–4 weight percent.

EXAMPLE II

This experiment demonstrates that both useful cyclic electrical properties and improved peel strength adhesion can be obtained in devices containing P(HEMA) blocking layers that have been doped with the 30 mole percent P(HEMA) benzoate ester copolymer versus the same devices in which dopant was omitted. The devices consisted of polyester (Mylar TM, available from E. I. duPont de Nemours & Co.) substrate, a semi-transparent sprayed carbon black-binder conductive layer, the doped P(HEMA) blocking layer, a charge generating layer containing vanadyl phthalocyanine particles dispersed in polyester (Vitel PE-100 resin, available from Goodyear) and a 25 micrometers thick charge transport layer consisting of 40 weight percent N,N'-bis (3" methylphenyl)-[1,1'-biphenyl]-4,4" diamine in polycarbonate (Makrolon 5705, available from from Farbenfabricken Bayer A. G.). All the layers were drawbar coated except for the conductive layer.

The carbon black dispersion for spray fabrication of the conductive layer was prepared by first dissolving 13.2 grams of methyl acrylamidoglycolate methyl ether—vinylpyrrolidone copolymer and 13.2 grams of a methyl acrylamidoglycolate methyl ether—vinylacetate copolymer in 97 grams DMF and 49 grams Dowanol PM. Then 6.75 grams of N,N'-bis (3" hydroxyphenyl)-[1,1' biphenyl]-4,4" diamine was dissolved in the above solution. Finally 8.25 grams carbon black (C-975 ultra, available from Columbian Chemicals Co.) and 500 grams stainless steel shot were added and the mixture was roll-milled for 5 days to produce a carbon black dispersion. After filtering the dispersion through a 28 micrometer Nitex nylon filter cloth and diluting with 90 grams tetrahydrofuran and 95 grams Dowanol PM, the diluted dispersion was sprayed in one pass onto the corona treated polyester substrate sheet mounted on a rotating metal drum. The solvent moist coating was dried for one hour at 135° C. in an air convection oven and had a resistivity of about 10 ohms/square. Next blended blocking layer solutions comprising P(HEMA) and the 30 mole percent P(HEMA) benzoate ester modified copolymer, prepared by modifying the unmodified high molecular weight P(HEMA) described in Part A of Example I, were prepared in Dowanol PM at 2 weight percent and 4 weight percent. These solutions were each drawbar coated onto the previously described conductive layers using a 0.5 mil drawbar gap to give dried blocking layer thicknesses of 0.2–0.4 and 0.5–0.7 micrometer respectively. The blocking layers were dried in an air convection oven for 1 hour at 110° C. Next a charge generator layer (CGL) dispersion was formulated and attrited on a large scale and was sampled as needed to drawbar coat charge generator layers in various photoreceptor devices in this Example. A solution of 233 grams polyester (Vitel PE-100 resin, available from Goodyear) and 3793 grams of methylene chloride was prepared by roll milling the mixture for at least 90 minutes in a 5 gallon polypropylene carboy. Using a slight positive pressure, this solution was filtered through a 0.2 micrometer millipore disposable filter. About 2,300 grams of the filtered polymer solution and 125.5 grams of vanadyl phthalocyanine pigment were mixed in a 1 gallon wide mouth plastic jug using a Tekmar Dispax Mixer (type T45 DPX 56) for about 10 minutes. Next this crude dispersion and an additional 700 grams of the above polymer solution used to flush the Dispax Mixer were added to the Union Process Attritor (Model Is) along with 2200 grams of 1,2-dichloroethane. The contents of the attritor were covered with aluminum foil sheeting to reduce solvent evaporation and the attritor was run at 180 RPM for 3 hours while running cold tap water through the attritor cooling jacket. The cooling maintained the dispersion at about 15° C. After 3 hours attriting, the attritor speed was reduced to 40 RPM and the drain valve was opened to empty the solution into a 2 gallon light tight plastic jug. The closed attritor was briefly rinsed with 1026 grams of the above polymer solution and 344 grams 1,2-dichloroethane. After agitating for 2 minutes at 180 RPM, the attritor speed was decreased to 40 RPM and the residual dispersion was flushed into the 2 gallon light tight plastic jug. The entire vanadyl phthalocyanine dispersion was roll mill for 15–30 minutes prior to drawbar coating a portion thereof. This dispersion contains about 5.35 weight percent solids, 3.48 percent of which is dissolved polyester (PE-100) and 1.87 percent dispersed vanadyl phthalocyanine. The vanadyl phthalocyanine comprises 35 weight percent of the dried coating after solvent removal and the solvent composition is 60 weight percent methylene chloride and 40 weight percent 1,2 dichloroethane. The dispersion was drawbar (0.5 mil gap) coated onto the dried blended P(HEMA) blocking layer and the solvent moist generating layer was dried in an air convection oven at 100°–110° C. for 1 hour. Finally the charge transport layer was formulated, coated and dried. To 183.5 grams methylene chloride was added 20 grams (60 weight percent solids) of polycarbonate (Makrolon 5705) and the mixture was magnetically agitated in a 32 oz amber glass bottle until a solution formed (24–36 hrs). To this solution was added 13.35 grams (40 weight percent solids) of the hole transport molecule, N,N'-bis(3"methylphenyl)-[1,1'-biphenyl]-4,4"diamine and the mixture was stirred for an additional 24 hours. This charge transport layer solution was drawbar coated (3 mil bar gap) onto the dried generating layer and the wet coating was briefly (about 0.5 hour) dried at room temperature and then in an air convection oven, wherein the temperature was gradually increased from room temperature to 110° C. over 1 hour and was then held at 110° C. for 0.5–1.0 hours. The transport layer dry thickness was 25±5 micrometers.

The completed photoreceptor was charge-erase cycled using a cyclic scanner having a single wire corotron (5 cm wide) set to deposit $14\times10^{-8}$ coulombs/cm of charge on the surface of these devices. The devices were grounded to an aluminum drum having a 63.1 cm circumference and the drum was rotated at a speed of 20 rpm to produce a surface speed of 8.3 inches per second and a cycle time of about 3 seconds. The devices were discharged (erased) with a short arc xenon lamp white light source (about 3000 ergs intensity) emitted through a fiber optic light pipe. In two tests, cutoff-filters (550 and 450 nanometers) were introduced at the erase lamp source to remove the short wavelength emission. The entire xerographic simulation (charge and erase) was carried out in an environmentally controlled light tight chamber. The devices in the following Table IB were charge-erase cycled for 200 cycles at ambient conditions (35 percent RH and 20° C.), and the cyclic electrical properties are indicated for different blending levels of the 30 mole percent P(HEMA) benzoate ester copolymer in the P(HEMA) blocking layer. Table IA describes the compositional variables of the blended blocking layers of this example.

TABLE IA

BLENDED ADHESIVE-BLOCKING LAYER COMPOSITIONS[a]

| Device No. | Peel Test Adhesion (g/cm) | BLENDED BLOCKING LAYER Modified P(HEMA) Copolymer (wt. %) | Unmodified P(HEMA) Homopolymer (wt. %) |
|---|---|---|---|
| 1 | <5 | 0.0 | 100.0 |
| 2 | 20–25 | 10.0 | 90.0 |
| 3 & 4 | 50–100 | 20.0 | 80.0 |
| 5 & 6 | >200 | 35.0 | 65.0 |
| 7 | >200 | 50.0 | 50.0 |

TOTAL REPEAT UNITS IN BLOCKING LAYER

| Device No. | Modified (wt %) | Modified (Mole %) | Unmodified (wt %) | Unmodified (Mole %) |
|---|---|---|---|---|
| 1 | 0.0 | 0.0 | 100.0 | 100.0 |
| 2 | 4.4 | 2.5 | 96.6 | 97.5 |
| 3 & 4 | 8.7 | 5.0 | 91.3 | 95.5 |
| 5 & 6 | 15.2 | 9.1 | 84.8 | 90.9 |
| 7 | 21.8 | 13.4 | 78.2 | 86.6 |

[a]All modified copolymers in these blocking layer compositions are 70 mole percent (56.45 wt. %) unmodified P(HEMA) repeat units and 30 mole percent (43.55 wt. %) P(HEMA) repeat units that have been modified with benzoyl chloride as in Example IA.

[b]Modified repeat units originate only from the modified copolymer defined in footnote a.

[c]Unmodified repeat units originate from the modified copolymer in footnote a (from the repeat units that did not undergo modification) and from all the repeat units in the unmodified P(HEMA) homopolymer.

Excellent adhesion (device 2) was obtained when as little as 2.5 out of every 100 repeat units in the blocking layer composition were modified as described in Part A of Example I. This large adhesion improvement for so small a number of modified repeat units suggests that modified copolymers, containing the modified repeat units, aggregate at the surface of the blocking layer during coating thereof, and that a special interfacial II bonding interaction may be occurring between the benzene rings of the modified P(HEMA) copolymer of the blocking layer and the benzene rings of the PE-100 polyester binder in the charge generating layer.

TABLE IB

ADHESIVE BLOCKING LAYER ELECTRICAL PROPERTIES

| Device No. | Peel Test Adhesion (g/cm) | BLENDED BLOCKING LAYER Wt. % Modified P(HEMA) Copolymer | Wt. % Unmodified P(HEMA) Homopolymer |
|---|---|---|---|
| 1 | <5 | 0 | 100 |
| 2 | 20–25 | 10 | 90 |
| 3 | 50–100 | 20 | 80 |
| 4 | 50–100 | 20 | 80 |
| 5 | >200 | 35 | 65 |
| 6 | >200 | 35 | 65 |
| 7 | >200 | 50 | 50 |

| Device No. | Blocking Layer Thickness[d] (micrometers) | CYCLIC ELECTRICAL PROPERTIES[e] Vo(I) | Vo(200) | Vr(I) | Vr(200) |
|---|---|---|---|---|---|
| 1 | 0.35–0.55 | 1040 | 1110 | 8 | 63[a] |
| 2 | 0.2–0.4 | 1471 | 1641 | 25 | 86[b] |
| 3 | 0.2–0.4 | 1459 | 1431 | 27 | 13 |
| 4 | 0.5–0.7 | 300 | 1288 | 30 | 13 |
| 5 | 0.2–0.4 | 1525 | 1377 | 32 | 23 |
| 6 | 0.5–0.7 | 1385 | 1300 | 30 | 17 |

TABLE IB-continued

ADHESIVE BLOCKING LAYER ELECTRICAL PROPERTIES

| | | | | | |
|---|---|---|---|---|---|
| 7 | 0.5–0.7 | 1174 | 1111 | 31 | 24 |

[a]550 nm cutoff filter used with erase lamp.

[b]450 nm cutoff filter used with erase lamp.

[c]Charge generating layer pigment binder ratio same but total solids level 50 percent of Devices 2–7.

[d]Thickness of blocking layer has no significant effect on the peel test adhesion.

[e]These 200 cycle electrical properties are satisfactory for normal imaging processes.

The cyclic electrical data indicate sufficient hole blocking capability (high $V_o$) for these blended blocking layers, comparable to the 100 percent P(HEMA) blocking layer and much improved versus the same devices without a blocking layer which only charge to about 600 volts. The photodischarge process to low residual voltage ($V_r$) is sufficiently complete when no cutoff filter is used with the erase lamp. Presumably the erase lamp cutoff filter diminishes the light intensity level to <3000 ergs allowing residual charge (photodischarged electrons) to become trapped in the device causing the observed Vr cycle-up.

The peel test adhesion in Table I was measured at an angle of 180° in the reverse peel test mode. Peel strength was measured on an Instrumentors Inc. Model SP-102C-3M90 Peel Tester. The instrument consisted of a calibrated load cell and moving platen with controlled variable speed. The instrument measured the force required to separate layers of a multilayer device. Since this force is a function of peel angle, all measurements were made with the angle at 180°. The electronic functions of the test equipment average the force measurements during the time the platen is moving and displays the average number on a digital meter. The instrument was calibrated to measure force in gram units. Also, since the peel strength is dependent on sample size, the force is divided by the sample width. Thus, peel strengths are reported as grams per cm. Test samples were prepared each approximately 1 cm wide by 25 cm long. The coating was partially stripped from the substrate and mounted on the platen with the substrate surface attached to the platen and the partly removed end placed in a clamp connected to a load cell. The platen was equipped with an adhesive material to firmly hold each sample. For normal peel tests, the coated layers were pulled from the substrate. For reverse peel tests, the coated side of the device was placed on the platen (coated side down) and the substrate was pulled from the coated layers. The platen speed used for these measurements was 1 inch per minute and the measurement time was 25 seconds.

The normal peel test values, indicative of delamination at the charge transport layer-charge generating layer interface, were always > or equal to 20 g/cm and, therefore, needed no improvement. The improvement in adhesion between the blocking layer and adjacent charge generating layer was large when as little as 10 weight percent of the 30 mole percent modified P(HEMA) benzoate ester copolymer was blended with 90 weight percent unmodified P(HEMA). This large improvement in adhesion with only 10 weight percent of the 30 mole percent modified P(HEMA) benzoate ester copolymer in 90 weight percent unmodified P(HEMA) indicates a selective migration of the benzoate ester polymer to the blocking layer surface because the total benzoate ester repeat unit content in the blocking layer is very low at about 2.5 mole percent. Blocking layer surface enrichment of the benzoate ester polymer such that at least about 21 percent of the total polymeric repeat units at the blocking layer surface are the modified benzoate ester repeat units is desirable for optimizing adhesion improvement because in Example III the 20 mole percent modified P(HEMA) benzoate ester copolymer alone failed to adhere significantly to the same charge generating layer. The 20 mole percent modified P(HEMA) benzoate ester copolymer must have about 20 mole percent of the modified benzoate ester repeat units at the blocking layer surface since this blocking layer composition comprises a single polymer component and thus significant selective migration and aggregation of modified copolymer cannot occur at the blocking layer surface.

EXAMPLE III

The purpose of this Example is to identify the minimum repeat unit content of P(HEMA) benzoate ester in the modified P(HEMA) copolymer (Example I; part A) required to improve blocking layer adhesion to the vanadyl phthalocyanine/polyester charge generating layer composition of photoreceptor devices. The devices consisted of a polyester substrate (Mylar), the same sprayed carbon black conductive layer composition described in Example II, various modification levels of chemically modified compositions of P(HEMA) coated from 3 weight percent solutions to give dried blocking layer thicknesses of about 0.35–0.55 micrometer, the same vanadyl phthalocyanine/polyester charge generating layer as Example II except at 50 weight percent of the solids level and the same charge transport composition described in Example II. All the layers were coated and dried as described in Example II.

The completed devices were electrically tested as described in Example II except a 550 nm short wavelength cutoff filter was routinely used with the erase lamp except for the 30 mole percent P(HEMA) benzoate ester modified copolymer blocking layer devices which were tested with and without the cutoff filter. The devices in the following Table II were charge-erase cycled for 200 cycles at ambient conditions (35 percent RH and 20° C.), and the cyclic electrical properties are indicated for blocking layers containing different modified copolymer levels of benzoate ester alone or blended with P(HEMA). Table IIA describes the compositional variables of the blocking layers of this example.

TABLE IIA

ADHESIVE-BLOCKING LAYER COMPOSITIONS

| Device No. | Peel Test Adhesion (g/cm) | P(HEMA) Copolymer Modification Level[b] (mole %) | Modified P(HEMA) Copolymer[c] (wt. %) | Unmodified P(HEMA) Homopolymer (wt. %) |
|---|---|---|---|---|
| 1 | 0.7 | 0.0 | 0.0 | 100.0 |
| 2 | 2.6 | 10.0 | 100.0 | 0.0 |
| 3 | 2.9 | 10.0 | 50.0 | 50.0 |
| 4 | 3.6 | 20.0 | 100.0 | 0.0 |
| 5 | 4.4 | 20.0 | 50.0 | 50.0 |
| 6 | <200[a] | 30.0 | 100.0 | 0.0 |
| 7 | 167[a] | 30.0 | 50.0 | 50.0 |

TOTAL REPEAT UNITS IN BLOCKING LAYER

| Device No. | Modified[d] (wt %) | Modified[d] (Mole %) | Unmodified[e] (wt %) | Unmodified[e] (Mole %) |
|---|---|---|---|---|
| 1 | 0.0 | 0.0 | 100.0 | 100.0 |
| 2 | 16.7 | 10.0 | 83.3 | 90.0 |
| 3 | 8.3 | 4.8 | 91.7 | 95.2 |
| 4 | 31.1 | 20.0 | 69.0 | 80.0 |
| 5 | 15.5 | 9.3 | 84.5 | 90.7 |
| 6 | 43.6 | 30.0 | 56.4 | 70.0 |
| 7 | 21.8 | 13.4 | 78.2 | 86.6 |

[a]Cohesive failure in carbon black polymer conductive layer; other delaminations are adhesive at the blocking layer - generator layer interface.
[b]Average benzoate ester repeat unit content per P(HEMA) polymer chain.
[c]All modified copolymers in these blocking layer compositions have been synthesized by the benzoyl chloride modification of P(HEMA) as described in Example IA.
[d]Modified repeat units originate only from the modified copolymers described in footnote c.
[e]Unmodified repeat units originate from the modified copolymer in footnote c (from the repeat units that did not undergo modification) and from all the repeat units in the unmodified P(HEMA) homopolymer.

TABLE IIB

ADHESIVE-BLOCKING LAYER ELECTRICAL PROPERTIES

| Device No | Peel Test Adhesion (g/cm) | P(HEMA) Copolymer Modification Level[b] (mole %) | Modified P(HEMA) Copolymer[c] (wt. %) | Unmodified P(HEMA) Homopolymer (wt. %) |
|---|---|---|---|---|
| 1 | 0.7 | 0.0 | 0.0 | 100.0 |
| 2 | 2.6 | 10.0 | 100.0 | 0.0 |
| 3 | 2.9 | 10.0 | 50.0 | 50.0 |
| 4 | 3.6 | 20.0 | 100.0 | 0.0 |
| 5 | 4.4 | 20.0 | 50.0 | 50.0 |
| 6 | >200[a] | 30.0 | 100.0 | 0.0 |
| 6 | >200[a] | 30.0 | 100.0 | 0.0 |
| 7 | 167[a] | 30.0 | 50.0 | 50.0 |
| 7 | 167[a] | 30.0 | 50.0 | 50.0 |

| Device No. | $V_o(1)$ | $V_o(200)$ | $V_r(1)$ | $V_r(200)$ |
|---|---|---|---|---|
| 1 | 1040 | 1110 | 8 | 63 |
| 2 | 1235 | 1377 | 25 | 151 |
| 3 | 1199 | 1305 | 18 | 119 |
| 4 | 1173 | 1295 | 24 | 120 |
| 5 | 1105 | 1143 | 19 | 91 |
| 6 | 939 | 815 | 19 | 43 |
| 6 | 951 | 711 | 20 | 24[c] |
| 7 | 976 | 925 | 15 | 42 |
| 7 | 984 | 834 | 13 | 10[c] |

[a]Cohesive failure in carbon black-polymer conductive layer; other delaminations are adhesive at the blocking - layer generator layer interface.
[b]Average benzoate ester repeat unit content per P(HEMA) polymer chain.
[c]$V_r$ lower without 550 nm cutoff filter; all other devices have 550 nm cutoff filter The improvement in adhesion for devices 6 and 7 versus devices 1–5 was large because the P(HEMA) benzoate ester modified repeat unit content in the modified copolymer was increased to 30 mole percent of the repeat units in the modified copolymer. This very large increase in blocking layer-charge generating layer adhesion in device 7 suggests selective migration of the benzoate ester modified copolymer to the blocking layer surface may be occurring while drying the blocking layer. However, the unblended 30 mole percent benzoate ester modified copolymer blocking layer device (6) also provides improved adhesion at the blocking layer-charge generating layer interface, and selective modified copolymer migration is impossible in this single component bulk homogeneous blocking layer. Thus, if the P(HEMA) benzoate ester modified repeat unit content is sufficient as in device 6, more than satisfactory adhesion at the blocking layer-charge generating layer interface is obtainable with either blended or unblended blocking layers.

Excellent hole blocking was obtained for all devices in Table II as evidenced by the high $V_o$ (1 and 200) values. However the use of the 550 nm cutoff filter contributes to $V_r$ cycle-up which is most obvious for device 1 wherein the blocking layer [100 percent P(HEMA)] is known not to cycle-up significantly on stable carbon black conductive layers, e.g. see EP 0 448 780 A1 to Spiewak et al, published Oct. 10, 1991. Comparing the cyclic electrical results of devices 6 and 7, with and without the erase lamp cutoff filter, indicates significant changes in $V_r$ result when the cutoff filter is omitted thus verifying that the cutoff filter contributes to $V_r$ cycle-up. The larger $V_r$ cycle-up for devices 2-5 implies electron trapping impurities reside in the 10 and 20 mole percent P(HEMA) benzoate ester blocking layer compositions. However since blocking layer-generating layer adhesion is poor in these devices, this result is insignificant.

EXAMPLE IV

The use of metallic conductive layers and generator layers containing trigonal selenium particles dispersed in poly vinylcarbazole with the 30 mole percent modified P(HEMA) benzoate ester copolymer alone as blocking layer also provided an electrically useful device with improved adhesion at the blocking layer-generating layer interface. The device consisted of a titanized Mylar conductive substrate onto which was drawbar (0.5 mil gap) coated a 6 weight percent Dowanol PM solution of the 30 mole percent P(HEMA) benzoate ester modified copolymer. The blocking layer was dried at 110° C. for 1 hour to form a layer 0.8-1 micrometer thick. The blocking layer was next coated with a charge generator layer dispersion. The charge generator layer mixture was prepared by forming a dispersion of about 8.57 g trigonal selenium particles doped with about 1-2 percent by weight sodium hydroxide, 16.72 g polyvinylcarbazole, 4.93 g N,N'-bis-(3''methylphenyl)-[1,1'-biphenyl]-4,4'diamine, 100.55 g tetrahydrofuran and 100.55 g toluene. This dispersion was then diluted with an equal weight of toluene. The diluted dispersion was next agitated on a wrist shaker for about 5 minutes immediately prior to coating the conductive layer with a 1 mil drawbar gap. The charge generator layer coating was next dried for one hour at room temperature and for one hour at 100° C. in an air convection oven. The dry thickness of the photogenerator layer thus obtained was about 1.0±0.3 micrometer. Finally the charge transport layer was formulated, coated, and dried as in Example II. The device was peel tested and charge-erase tested as described in Example II for 200 cycles at ambient conditions (35 percent RH and 20° C.). The peel test adhesion at the blocking layer-generating layer interface was found to be about 23 g/cm with the delamination occurring at the conductive layer-blocking layer interface indicating the blocking layer-generating layer interface to be even stronger. The cyclic electrical properties were excellent: $V_o$(I) 1320 volts, $V_o$(200) 1310 volts, $V_r$(1) 42 volts, Vr (200) 45 volts.

Another device was drawbar coated on a conductive titanized Mylar substrate. The blocking layer (0.2 to 0.4 micrometer) was drawbar coated (0.5 mil gap) from a 2 weight percent Dowanol PM solution containing 90 weight percent P(HEMA) and 10 weight percent of the 30 mole percent modified P(HEMA) benzoate ester copolymer. Charge generator and transport layers were drawbar coated as described in Example 2 using the same formulation, coating and drying conditions. The device was electrically tested (200 cycles) as described in Examples II and III, and was also charge-erase cycled using a motionless scanner at 33 percent RH and 21° C. for 3000 cycles. For motionless scanner testing, a gold film dot (about 150 Å thick) of 0.315 $cm^2$ area was vacuum deposited on the surface of the device as the top electrode. The device was charged to its voltage in the dark by connecting the top gold electrode and the bottom ground plane (conductive layer) to a DC power supply (Trek 609A). The charging time was controlled by a relay in series with the DC power supply. The surface voltage of the device was measured by a capacitance coupled voltage probe (Trek 565 electrostatic voltmeter and probe). After charging, the device was erased form the top surface by a white light flash lamp (1538A Strobotac from General Radio) and no cutoff filter was used to adjust wavelength exposure and overall intensity. The DC power supply, relay and the flash lamp were interfaced to and remote controlled by a personal computer. The cycling test was performed by repeating the charge-erase step monitored by the personal computer. The device in this Example was charged by passing a constant current, equivalent to 155 ncoulombs/$cm^2$, provided by the DC power supply for 200 msec. The device was then allowed to remain in the dark and was erased later. The total cycle time was 2.84 sec/cycle[a]. The $V_o$ value was the voltage directly after charging and the residual voltage ($V_r$) after erase. The following table summarizes the cyclic charge-erase data for the described device when tested by both scanners.

TABLE III

| Scanner Mode (charging Method) | x cycles | Vo(1) | Vo(x) | Vr(1) | Vr(x) |
|---|---|---|---|---|---|
| Motion[a] (corotron) | 200 | 1128 | 1450 | 11 | 123[b] |
| Motionless (electrode) | 3000 | 930 | 1043 | 48 | 49[c] |

[a]Scanner used in Examples II & III.
[b]450 nm erase lamp cutoff filter used.
[c]No erase lamp cutoff filter used.

The $V_r$ cycle-up associated with the erase lamp cutoff filter was again observed to occur and then disappear when the same device was tested in the motionless scanner without the erase lamp cutoff filter for 3000 cycles. Although this device was not peel tested, acceptable adhesion is anticipated with delamination probably occurring at the titanium conductive layer-blocking layer interface (as described for the first device in this Example) since the blocking layer-generating layer interfacial adhesion is known to be large (Example II, Table I, Device No. 2).

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a supporting substrate, a charge blocking layer, an imaging layer comprising at least one photoconductive layer, said blocking layer comprising an uncrosslinked chemically modified copolymer derived from vinyl hydroxy ester or vinyl hydroxy amide repeat units, between about 21 and about 75 mole percent of said vinyl hydroxy ester or vinyl hydroxy amide repeat units being chemically modified at a nucleophilic hydroxyl group by a monofunctional electrophile, said copolymer having a number average molecular weight of at least about 10,000.

2. An electrophotographic imaging member according to claim 1 wherein said vinyl hydroxy ester or vinyl hydroxy amide repeat units make up between about 50 and about 100 mole percent of said polymer prior to chemical modification.

3. An electrophotographic imaging member according to claim 1 wherein an average of between about 30 mole percent and about 50 mole percent of said vinyl hydroxy ester or vinyl hydroxy amide repeat units is chemically modified by said monofunctional electrophile.

4. An electrophotographic imaging member according to claim 1 wherein between about 40 and about 60 mole percent of said vinyl hydroxy ester or vinyl hydroxy amide repeat units is chemically modified by said monofunctional electrophile.

5. An electrophotographic imaging member according to claim 1 wherein said polymer is a copolymer comprising at least about 50 mole percent of said vinyl hydroxy ester or vinyl hydroxy amide repeat units prior to chemical modification.

6. An electrophotographic imaging member according to claim 1 wherein said copolymer is a terpolymer comprising at least about 50 mole percent of said vinyl hydroxy ester or vinyl hydroxy amide repeat units prior to chemical modification.

7. An electrophotographic imaging member according to claim 1 wherein said vinyl hydroxy ester or vinyl hydroxy amide repeat units are chemically modified prior to the formation of said copolymer.

8. An electrophotographic imaging member according to claim 1 wherein said vinyl hydroxy ester or vinyl hydroxy amide repeat units are chemically modified after formation of said copolymer.

9. An electrophotographic imaging member according to claim 1 wherein said imaging layer comprises a charge generating layer and a charge transport layer.

10. An electrophotographic imaging member according to claim 1 wherein said monofunctional electrophile is selected from the group consisting of a carboxylic acid chloride, a carboxylic acid anhydride and an isocyanate, a sulfonyl chloride, an alkyl halide, an activated aryl halide, an activated ester, and reactive monofunctional heteroatom halides.

11. An electrophotographic imaging member according to claim 1 wherein said blocking layer comprises a blend of said chemically modified vinyl hydroxy ester or vinyl hydroxy amide copolymer and a completely chemically modified vinyl hydroxy ester or vinyl hydroxy amide polymer.

12. An electrophotographic imaging member according to claim 1 wherein said blocking layer comprises a blend of said chemically modified vinyl hydroxy ester or vinyl hydroxy amide copolymer, an unmodified vinyl hydroxy ester or vinyl hydroxy amide polymer, and a completely chemically modified vinyl hydroxy ester or vinyl hydroxy amide polymer.

13. An electrophotographic imaging member according to claim 1 wherein said blocking layer comprises a blend of said chemically modified vinyl hydroxy ester or vinyl hydroxy amide copolymer and an unmodified vinyl hydroxy ester or vinyl hydroxy amide polymer.

14. An electrophotographic imaging member according to claim 13 wherein said blocking layer comprises between about 50 mole percent and about 99.5 mole percent of said unmodified vinyl hydroxy ester or vinyl hydroxy amide polymer, based on the total repeat units in said blocking layer.

15. An electrophotographic imaging member according to claim 13 wherein said unmodified vinyl hydroxy ester or vinyl hydroxy amide polymer comprises vinyl hydroxy ester or vinyl hydroxy amide repeat units represented by the following formula:

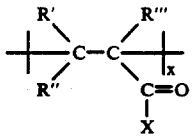

wherein:

R', R'' and R''' are independently selected from the group consisting of hydrogen, aliphatic, aromatic, heteroaliphatic, heteroaromatic, fused aromatic ring and heteroaromatic ring groups containing up to 10 carbon atoms, x represents the number of unmodified repeat units in the homopolymer, X is selected from the group consisting of groups represented by the following groups:

$$-O-R-(OH)_z,\ -NH-R-(OH)_z,$$

$$-NR-R-(OH)_z \text{ and } -N\begin{matrix} R-(OH)_z \\ R-(OH)_z \end{matrix}$$

wherein

R is selected from the group consisting of aliphatic, aromatic, heteroaliphatic, heteroaromatic, fused aromatic ring and heteroaromatic ring groups containing up to 10 carbon atoms, and z is from 1 to 10 hydroxyl groups.

16. An electrophotographic imaging member according to claim 1 wherein said vinyl hydroxy ester or vinyl hydroxy amide repeat units in said chemically modified copolymer are represented by the following formula:

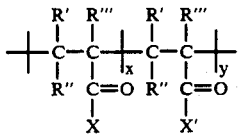

wherein for Unmodified Repeat Unit A:

R', R'' and R''' are independently selected from the group consisting of hydrogen, aliphatic, aromatic, heteroaliphatic, heteroaromatic, fused aromatic ring and heteroaromatic ring groups containing up to 10 carbon atoms, x represents the number of repeat units of Unmodified Repeat Unit A in said polymer and which can be 0 or greater, X is selected from the group consisting of groups represented by the following:

$$-O-R-(OH)_z,\ -NH-R-(OH)_z,$$

$$-NR-R-(OH)_z \text{ and } -N\begin{matrix} R-(OH)_z \\ R-(OH)_z \end{matrix}$$

wherein

R is selected from the group consisting of aliphatic, aromatic, heteroaliphatic, heteroaromatic, fused aromatic ring and heteroaromatic ring groups containing up to 10 carbon atoms, and z is from 1 to 10 hydroxyl groups, and wherein for Modified Repeat Unit B:

R', R'' and R''' are independently selected from the group consisting of hydrogen, aliphatic, aromatic, heteroaliphatic, heteroaromatic, fused aromatic ring and heteroaromatic ring groups containing up to 10 carbon atoms, y represents the number of repeat units of Modified Repeat Unit B in the copolymer and x plus y represent sufficient repeat units for a molecular weight of at least about 10,000, X' is selected from the group consisting of groups represented by the following:

$$-O-R-(OZ)_{z'},\ -NH-R-(OZ)_{z'},$$

$$-NR-R-(OZ)_{z'} \text{ and } -N\begin{matrix} R-(OZ)_{z'} \\ R-(OZ)_{z'} \end{matrix}$$

wherein

R is selected from the group consisting of aliphatic, aromatic, heteroaliphatic, heteroaromatic, fused aromatic ring and heteroaromatic ring groups containing up to 10 carbon atoms, Z represents a moiety from the monofunctional electrophile, and z and z' are whole numbers wherein:

$z \geqq z'$, and z minus z'=the remaining hydroxyl groups per repeat unit.

17. An electrophotographic imaging member according to claim 1 wherein said imaging member comprises said charge blocking layer, a charge generating layer, and a thin continuous interfacial zone at the interface between said charge blocking layer and said charge generating layer, said charge generating layer comprising a film forming polymer partially compatible with said chemically modified copolymer and said interfacial zone comprising a mixture of said film forming polymer and said chemically modified polymer.

18. An electrophotographic imaging process comprising an electrophotographic imaging member comprising a supporting substrate, a charge blocking layer, an imaging layer comprises at least one photoconductive layer, said blocking layer comprising an uncrosslinked copolymer derived from vinyl hydroxy ester or vinyl hydroxy amide repeat units, between about 21 and about 75 mole percent of said vinyl hydroxy ester or vinyl hydroxy amide repeat units being chemically modified at a nucleophilic hydroxyl group by a monofunctional electrophile, said polymer having a number average molecular weight of at least about 10,000, forming an electrostatic latent image on said imaging surface, contacting said imaging surface with a developer comprising electrostatically attractable marking particles whereby said electrostatically attractable marking particles deposit on said imaging surface in conformance with said electrostatic latent image to form a marking particle image, transferring said marking particle image to a receiving member, and repeating said forming, contacting and transferring steps at least once.

19. An electrophotographic imaging process according to claim 18 wherein said blocking layer also comprises an unmodified vinyl hydroxy ester or vinyl hydroxy amide polymer.

20. An electrophotographic imaging process according to claim 18 wherein said vinyl hydroxy ester or vinyl hydroxy amide repeat units are represented by the following formula:

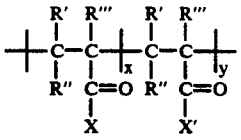

Unmodified Repeat Unit A  Modified Repeat Unit B wherein for Unmodified Repeat Unit A:

R', R'' and R''' are independently selected from the group consisting of hydrogen, aliphatic, aromatic, heteroaliphatic, heteroaromatic, fused aromatic ring and heteroaromatic ring groups containing up to 10 carbon atoms, x represents the number of repeat units of Unmodified Repeat Unit A in said polymer and which can be 0 or greater, X is selected from the group consisting of groups represented by the following:

$$-O-R-(OH)_z,\ -NH-R-(OH)_z,$$

$$-NR-R-(OH)_z \text{ and } -N\begin{matrix} R-(OH)_z \\ R-(OH)_z \end{matrix}$$

wherein

R is selected from the group consisting of aliphatic, aromatic, heteroaliphatic, heteroaromatic, fused aromatic ring and heteroaromatic ring groups containing up to 10 carbon atoms, and z is from 1 to 10 hydroxyl groups, and wherein for Modified Repeat Unit B:

R', R'' and R''' are independently selected from the group consisting of hydrogen, aliphatic, aromatic, heteroaliphatic, heteroaromatic, fused aromatic ring and heteroaromatic ring groups containing up to 10 carbon atoms, y represents the number of repeat units of Modified Repeat Unit B in the copolymer and x plus y represent sufficient repeat units for a molecular weight of at least about 10,000, X' is selected from the group consisting of groups represented by the following:

$$-O-R-(OZ)_{z'},\ -NH-R-(OZ)_{z'},$$

$$-NR-R-(OZ)_{z'} \text{ and } -N\begin{matrix} R-(OZ)_{z'} \\ R-(OZ)_{z'} \end{matrix}$$

wherein

R is selected from the group consisting of aliphatic, aromatic, heteroaliphatic, heteroaromatic, fused aromatic ring and heteroaromatic ring groups containing up to 10 carbon atoms, Z represents a moiety from the monofunctional electrophile, and z and z' are whole numbers wherein: $z \geqq z'$, and z minus z'=the remaining hydroxyl groups per repeat unit.

* * * * *